United States Patent [19]

Irwin

[11] 4,454,712

[45] Jun. 19, 1984

[54] ROTATING CYLINDER EXTERNAL COMBUSTION ENGINE

[76] Inventor: Everett F. Irwin, 430 Orangewood Dr., Dunedin, Fla. 33528

[21] Appl. No.: 216,629

[22] Filed: Dec. 15, 1980

[51] Int. Cl.[3] ..... F02G 3/02

[52] U.S. Cl. ..... 60/39.63; 91/152; 91/492; 123/204

[58] Field of Search ..... 60/39.6, 39.63, 620, 60/623; 91/152, 492; 123/204, 215; 418/13

[56] References Cited

U.S. PATENT DOCUMENTS

| | | | |
|---|---|---|---|
| 611,125 | 9/1898 | Humphrey | 60/39.6 X |
| 1,765,716 | 6/1930 | Curtis et al. | 60/620 X |
| 2,324,291 | 7/1943 | Dodge | 417/273 X |
| 2,684,038 | 7/1954 | Johnson | 91/493 |
| 3,581,718 | 6/1971 | Petty | 123/44 D |
| 3,989,011 | 11/1976 | Takahashi | 123/204 |

FOREIGN PATENT DOCUMENTS

| | | | |
|---|---|---|---|
| 2311183 | 12/1976 | France | 123/44 D |

*Primary Examiner*—Michael Koczo

[57] ABSTRACT

An external combustion engine has at least two axially spaced banks of radially disposed cylinders formed in a rotating engine block. A reciprocating piston is mounted in each cylinder. The block is rotatably mounted in an external engine housing and rotates about a first axis. A drive shaft is rotatably mounted in the external housing along a second axis parallel to but displaced from the first axis. The drive shaft extends through the central portion of the engine block and has a polygonal cross section with as many faces as there are pistons in each bank. Each piston engages a respective face of the polygonal drive shaft so that as the drive shaft and the engine block rotate together, the relative eccentric motion therebetween causes the pistons in each bank to reciprocate within their respective cylinders. A first bank of pistons is dedicated to the intake and compression of air drawn in from an air intake port in the external housing. A combustion chamber is mounted on the external housing within which fuel is continuously combusted with the compressed air supplied by the first bank of cylinders. The second bank of pistons is dedicated to converting the energy generated by the expanding exhaust gases in the combustion chamber into useful mechanical energy.

10 Claims, 55 Drawing Figures

SEC. 3-3

POWER BANK

SEC. 2-2

COMPRESSION BANK

SEC. 8-8

SEC. 6-6

SEC. 5-5

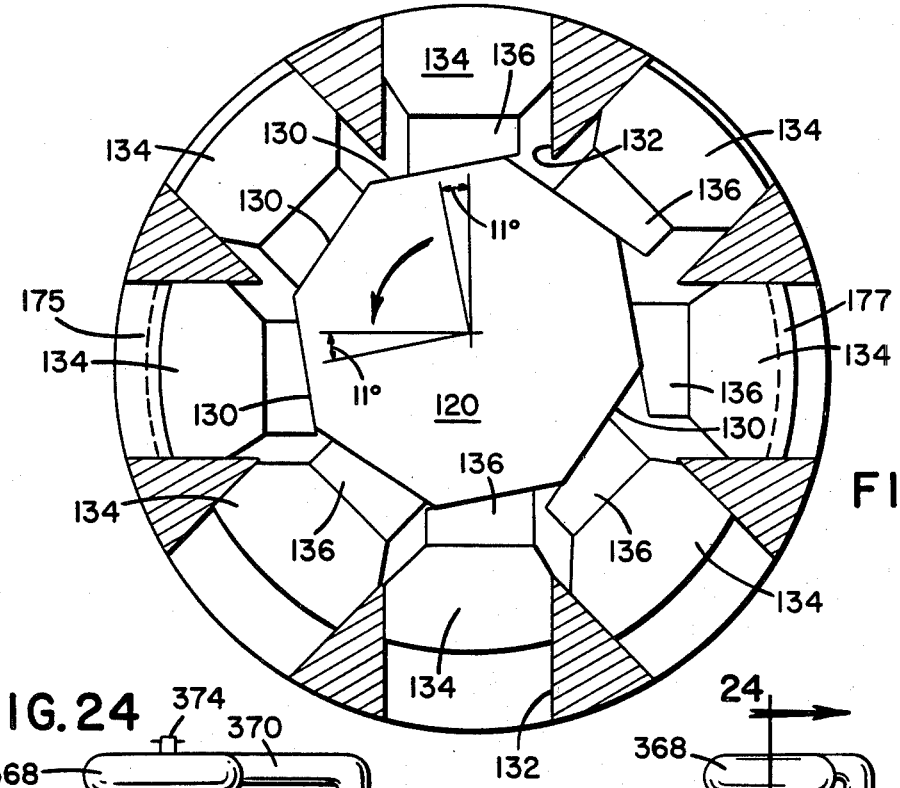
FIG. 17
FIG. 24
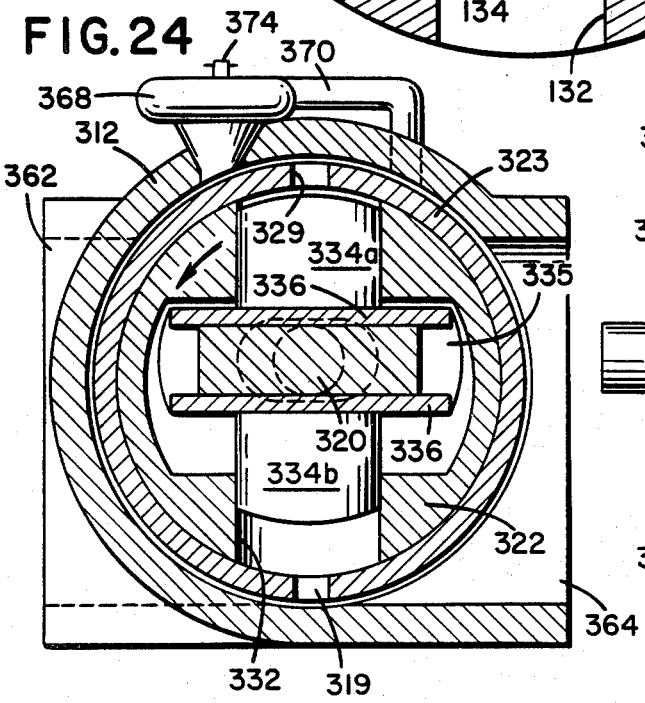
FIG. 23
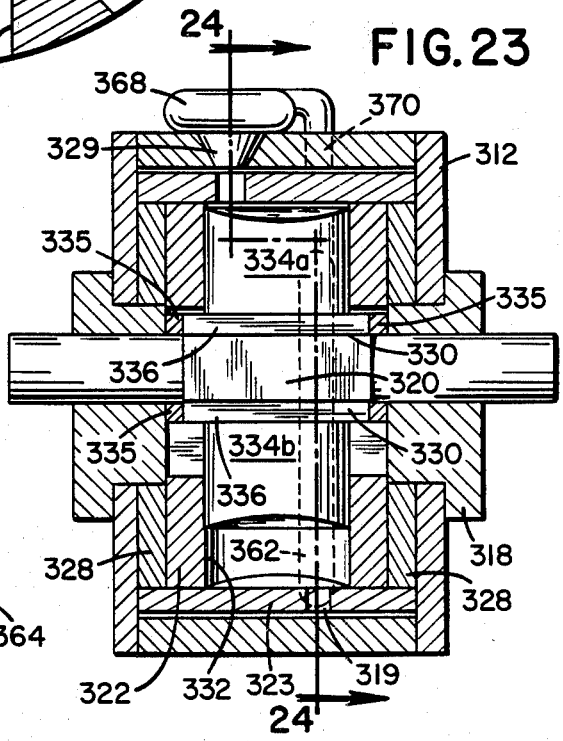
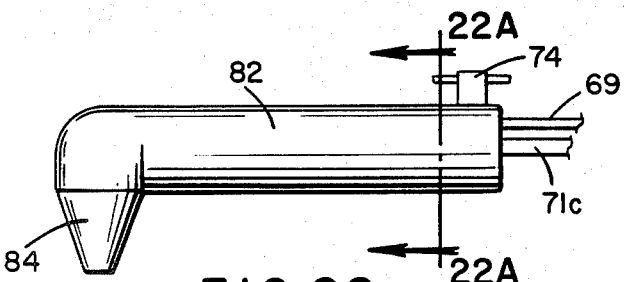
FIG. 22
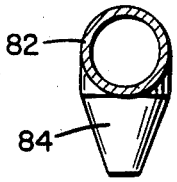
FIG. 22A

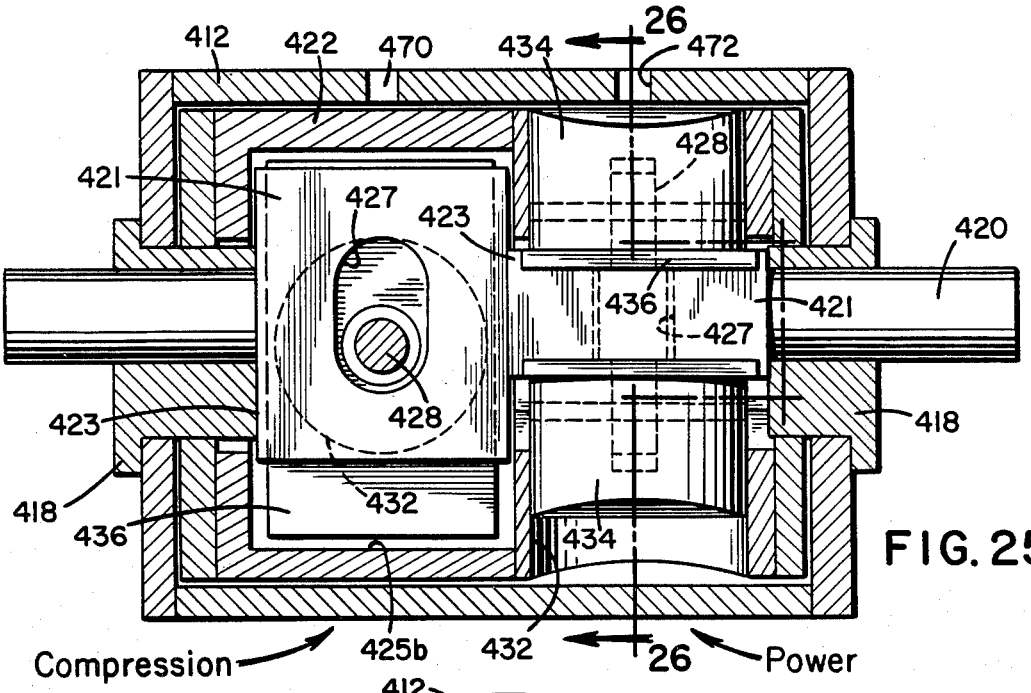
FIG. 25
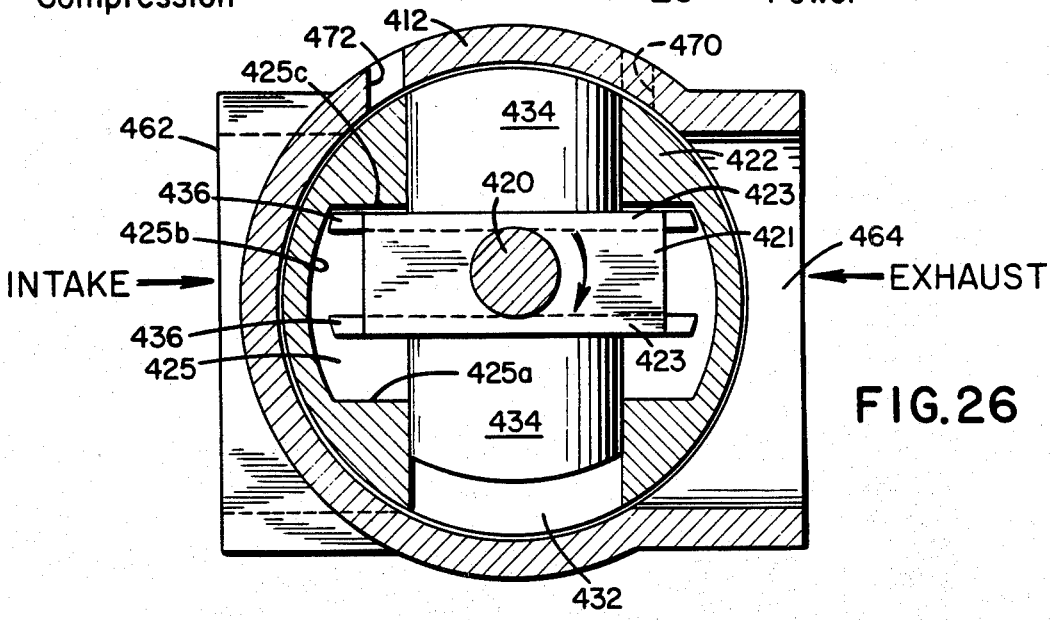
FIG. 26
FIG. 20
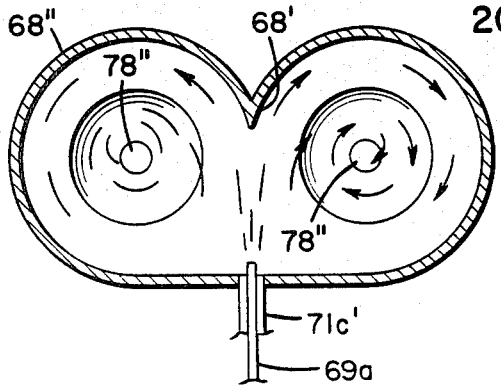
FIG. 21
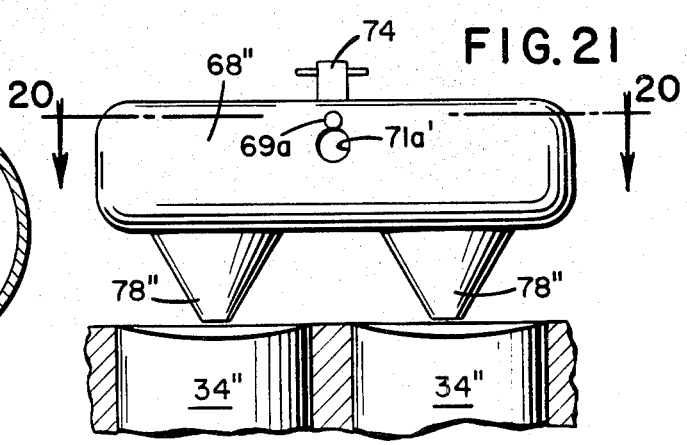

SEC A-A'

SEC B-B'

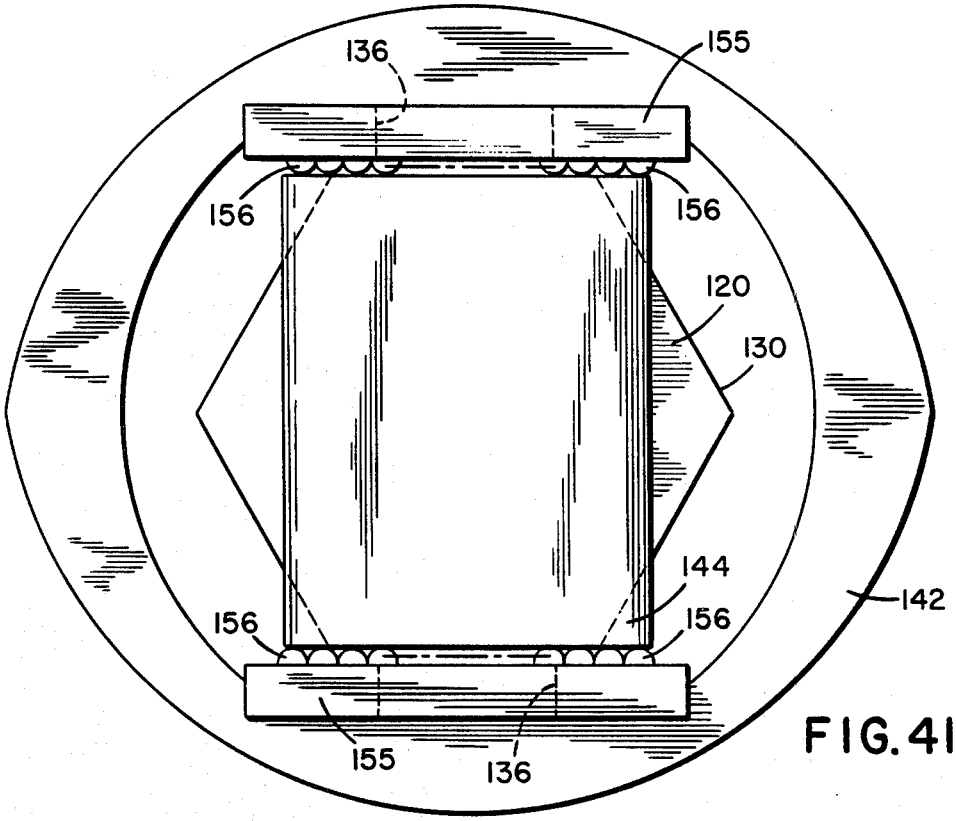
FIG. 41
FIG. 42
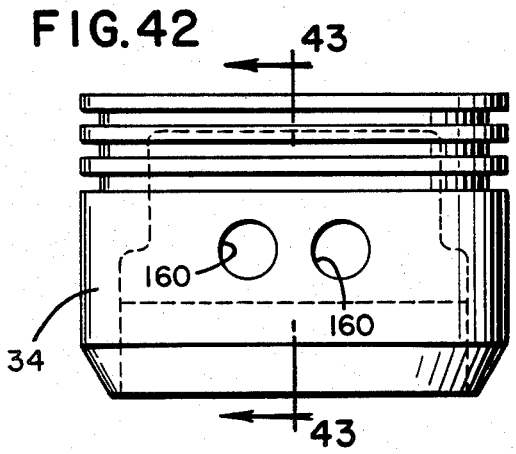
FIG. 43
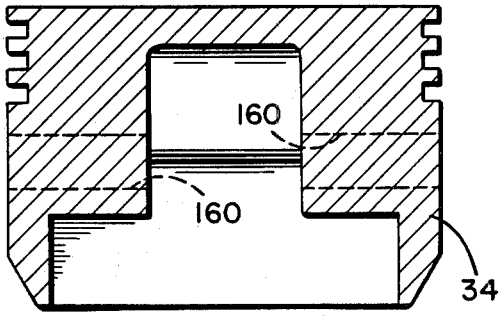
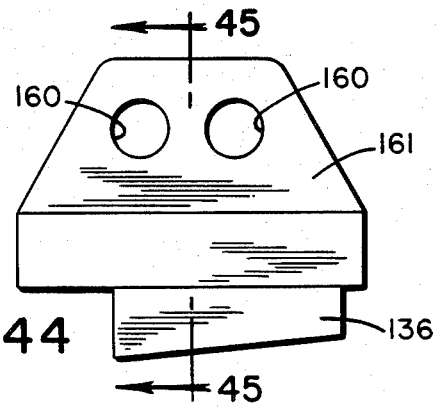
FIG. 44
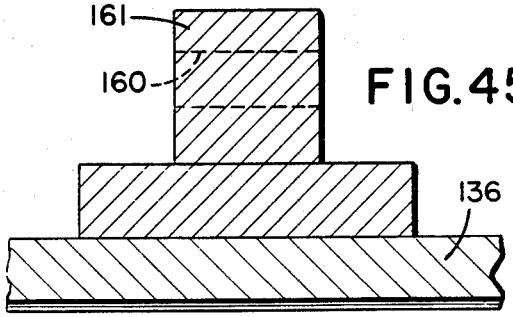
FIG. 45

FIG. 46
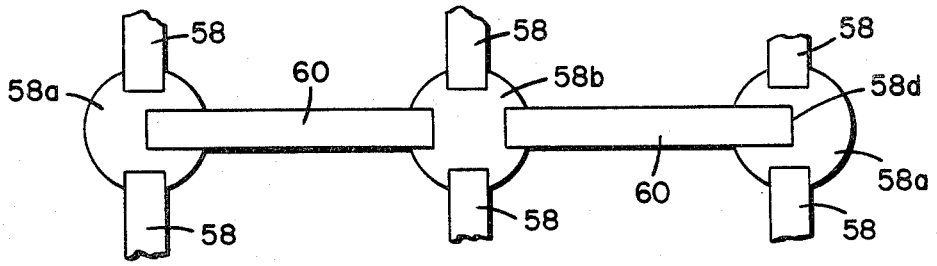
FIG. 47
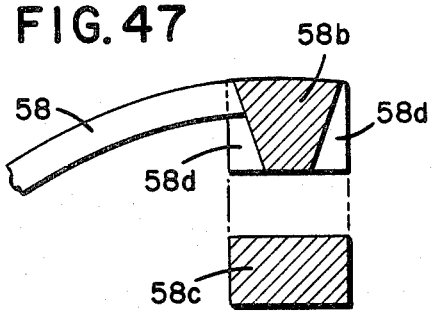
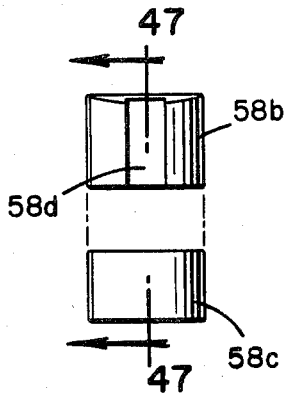
FIG. 48
FIG. 51
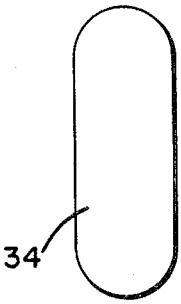
FIG. 49
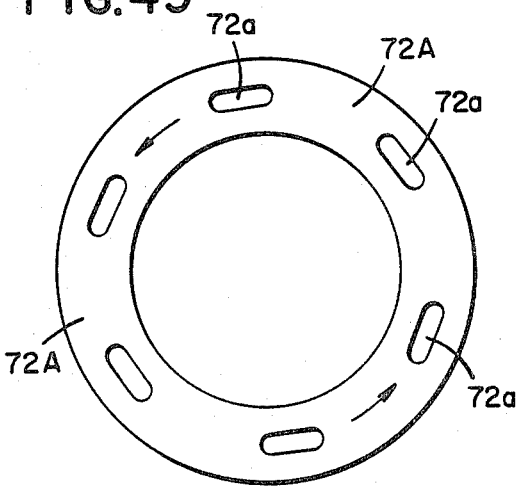
FIG. 50
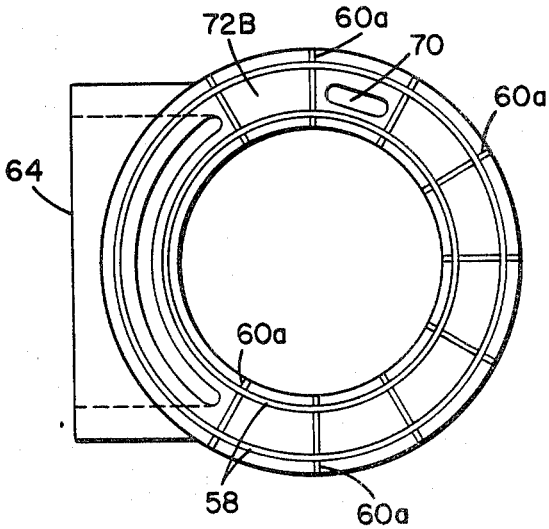

ROTATING CYLINDER EXTERNAL COMBUSTION ENGINE

FIELD OF THE INVENTION

This invention relates generally to fluid displacement devices such as rotary engines and more particularly to improvements in rotary engines of the radial piston type, and which are adaptable for use as external combustion engines, fluid pumps or motors, a gas compressor or motor pump, or combinations thereof.

BACKGROUND OF THE INVENTION

In recent years there has been a distinctly increasing recognition of the disadvantages and limitations of convention reciprocating piston engines, particularly when compared to rotary engines. Because internal combustion piston engines have relatively unfavorable power-to-weight and torque characteristics, require burning of relatively high octane fuels in many instances, emit considerable amounts of increasingly objectionable harmful exhaust pollutants, have a relatively short life due to vibrational wear and lubrication problems, it has become recognized that such reciprocating piston engines are considered relatively inefficient and need improving upon.

Numerous rotary engine designs have been proposed in attempts to solve the problems inherent in the more conventional reciprocating piston engines. Most of the more recently developed activity in this field has been for the internal combustion form of these rotary engines in an attempt to reduce air pollution from conventional reciprocating piston type engines. Various forms of the rotary engines have been developed and which attempt to duplicate or replace the usual intake-compression-power-exhaust cycle of the conventional internal combustion engine. Among such prior art rotary engines are the eccentric rotor engines, such as the Wankel engine in which a rotor moves about a fixed gear within a trochoidal stator and with power delivered through an eccentric drive. Some other types of rotary engines include those known as cat-and-mouse engines in which a plurality of pistons travel in a circular path; multiple rotor engines employing two intermeshing rotors which turn about parallel axes; and some revolving cylinder block engines which combine reciprocating piston motion with rotational motion of the engine block, as in the present invention. However, some of the foregoing rotary engine designs still have certain drawbacks or limitations, which include problems in fuel economy, and hydrocarbon emission control, and which, for example, relative to the eccentric rotor type of engines include problems in cooling of the elements and in sealing of the engine chambers.

Therefore, a need exists for an improved rotary engine which eliminates or reduces the many inherent problems of existing engines of both the reciprocal piston and rotary engine type. Additionally, such an engine is needed which is economically feasible and one which may be adapted for several different types of commercial applications while substantially reducing harmful exhaust emissions.

OBJECTS OF THE INVENTION

It is a general object of this invention to provide an improved rotary engine adapted for use in different embodiments as an external combustion engine, a fluid pump/motor, a gas compressor or vacuum pump.

A principal object is to provide an improved rotary engine of the external combustion type essentially having a constant flow of gases through it, and substantially constant pressures of the fluid transferring into and from the external combustion chamber.

A specific object of this invention is to provide a rotary engine embodying an eccentric rotary drive shaft of polygonal shaped cross-section uniquely related to and driven by reciprocable, radially disposed pistons within a rotary cylinder block, and one in which the fuel burns continuously and more completely in the external combustion chamber, and therefore no repetitive ignition is necessary after the device has been initially started.

A further object of this invention is to provide an improved engine which will not only burn relatively low cost liquid fuel, but will have more complete combustion and thereby greatly reduce harmful exhaust emissions. In alternate embodiments, the operating efficiency will be increased by reducing exhaust pressures.

Still another object is to provide an engine of this character which will help eliminate the tendency found in conventional engines for unburned gases to collect on the combustion chamber walls due to their cooling effect, at the expense of fuel economy and pollution.

Yet another object is to provide an engine of the foregoing character in which the engine components are so disposed that the flat surfaces of the faces of the pologonical shaped, cross-sectional drive shaft in one embodiment are perpendicular to the axis of the corresponding radially disposed pistons and piston chambers; and in another embodiment are advanced so that the flat surfaces of the shaft are not perpendicular so that for certain constructions they may impart accelerated movement of the power pistons during a major portion of the expansion cycle, while simultaneously accelerating a major portion of the exhaust and compression cycles.

And still another object is that, not only are the flat surfaces of the drive shaft advanced, but also, the piston cylinders and their pistons are advanced so that a longer lever is provided for more efficient utilization of the power produced from the combusted gases. At the same time this arrangement will provide a shorter lever for more efficient compression of the gases during the compression cycle.

A further object is to provide an engine designed to have a surrounding water jacket to provide for the liquid cooling thereof. The rotating cylinder block may have oil flowing in the central cavity cooling the lower part of the cylinder walls and the pistons. The cylinder block can also be designed to flow coolant in a jacket provided around the cylinder walls. And in another embodiment the oil will flow through the cylinder jacket and through a jacket provided in the head and into an outer cylindrical collecting pan.

Further objects of this invention include the unique and improved details of construction and arrangement whereby a relatively simple, more efficient and extremely compact engine of this character is provided.

The foregoing and additional objects and advantages of the invention are achievable by the form of a preferred embodiments briefly summarized in the Abstract hereinabove and also as per the following summary of the engine and its operational characteristics such as shown in FIGS. 1, 2, and 3.

SUMMARY OF THE INVENTION

These and other objects are accomplished by the compact fluid displacement machine disclosed, which is a rotary external combustion engine generally of the radial piston type, having improved ecological, economical and power-to-weight and torque performance. The combustion chamber is mounted above a fixed outer housing having a cylindrical inner periphery within which a complementally shaped cylinder block rotates with its outer periphery in sealing contact with the internal peripheral wall of the fixed housing. The center axis of the housing and rotary cylinder block are co-axial, but the rotary drive shaft, with its polygonal shaped intermediate cross-section, is eccentrically disposed relative thereto with the shaft ends rotatably journaled in opposite ends of the housing. The pistons are operatively engaged by the drive shaft and the eccentric mounting thereof determines the throw of the pistons. The rotary cylinder block houses at least one and preferably two or more axially spaced banks of a plurality of evennumbered piston chambers spaced circumferentially around and radially from its axis and from the rotary drive shaft. There are as many planar surfaces of the polygonal cross-sectional drive shaft as there are cylinders and pistons in each bank of the rotary cylinder block. The corresponding pistons of the respective banks are operatively interconnected with each other and with said drive shaft, preferably by a common elongated, piston-mounting base plate and reciprocatingly bear upon the rotary transverse movement of each corresponding common planar face of the rotary drive shaft. Diametrically opposite pairs of the piston-mounting-base plates are connected together by unique bridle rings to provide synchronous opposite diametrical movements incident to operation of the device. This assures improved distribution of forces between opposed groups of pistons and provides improved rotational balance, alignment and articulation of associated engine components. The pistons of each bank are sequentially progressively movable between their fully extended and fully retracted movements radially within their respective chambers during the first 180° cycle by the aforesaid reciprocating movements, and are subsequently movable back again to their fully radially extended condition during the next 180° cycle due to the relative eccentricity of the rotary drive shaft and rotary block. One bank of pistons and chambers serves as a fluid intake and compressing means for introducing and compressing volumes of fluid, such as air, into the external combustion chamber into which a liquid fuel is also introduced for mixing therewith. The engine may have a combustible fuel mixture introduced by means of a carburetor, or by means of separately injecting liquid fuel and air directly into the combustion chamber. The externally disposed combustion chamber is of a suitable volume providing a relatively slow continuous burning of the incoming air/fuel mixture directed thereto by suitable flow passages. The fuel and air mixture is preferably introduced in a tangential manner into the combustion chamber in a centrifuge-like manner to effect more complete burning. The expanding combusted gases are directed therefrom by one or more outlet transfer ports to the pistons of the second or more banks of power-driving pistons to apply torque to the drive shaft. The intake and compression cycles of the pistons of one bank run synchronously with the power-driving and exhaust cycles of the pistons of the adjacent bank.

More particularly, there are two 180° cycles for each of the pistons in adjacently disposed banks of the fluid intake/compression and power/expansion or exhaust phases of operation. At the start of the cycle, the rotary cylinder block is disposed with pistons of the respective banks at the top of their stroke, whereby the intake/compression cylinders and pistons move counter-clockwise in FIGS. 2 and 3 with the eccentrically disposed rotary drive shaft as illustrated therein. The pistons begin to ove radially inward within their respective piston chambers and as the intake/compression pistons pass the intake port, they commence to draw in air, which procedure continues throughout the balance of the 180° downstroke cycle. At the bottom dead center position, with the pistons in their retracted state within the piston cylinders, they pass beyond and become closed off from the intake port and then commence to compress the trapped air during the 180° upstroke cycle. At a predetermined position in their upstroke after the air compression is achieved, the compression pistons and piston chambers come into communication with the transfer port leading to the external, combustion chamber, whereupon the compressed air, or other intake fluid, is forced into a combustion chamber where the combination fuel and air mixture is ignited. In the preferred embodiments using both 6 and 8 pistons per bank, the flow of compressed air to the combustion chamber is essentially continuous. After the mixture is thoroughly burned, the hottest gases which have collected in the center of the combustion chamber are forced out through the fluid transfer port against the passing pistons in the adjacent bank to constitute the 180° downstroke power cycle thereof to impart rotary drive to the output shaft. When the pistons reach bottom dead center, or thereabout, they open into communication with the exhaust manifold (FIG. 2), and during most of their 180° upstroke cycle force out and expel burned gases. Both the inlet transfer port to and the outlet transfer port from the combustion chamber are closed for a short predetermined time during the respective cycles. The exhaust port is related to the outlet transfer port from the combustion chamber so that a small portion of the burned gases remain trapped in the cylinders to act as a cushion against the high pressure of a new charge of burning gases as the pistons pass top dead center. The two 180° cycles for each of the respective banks of cylinders are traversed simultaneously during each single 360° revolution of the rotary block and drive shaft.

The combustion chamber is preferably either of cylindrical, or of combined cylindrical and generally frusto-conical form, and with air and fuel being introduced as a mixture preferably in a tangential manner so as to induce a circular centrifuge-like motion thereto. This causes the heavier unburned fuel to remain in the circumferentially outer part of the burner long enough to have time to burn more completely, thereby providing a hydrocarbon emission control and improved economy. Unlike internal combustion engines using conventional spark plugs or similar type flash ignition which makes for a high peak temperature, this novelly improved engine, like the diesel engine, does not have flash explosion but, instead, has an essentially constant pressure in this external combustion chamber which is of the continuously burning character, and is used continuously for all power cylinders. The continuously heated combustion chamber's inner walls in the present engine, therefore, do not tend to cool down, thereby greatly reducing thermally induced stresses and precluding heat loss during incoming and outgoing fluid transfer.

The outlet transfer port from the combustion chamber directs the expanding gas pressure against the power pistons only after they pass their top dead center position and commence their downward stroke. This outlet port is of a size as to remain open sufficiently to allow the piston cylinder or piston chamber to become filled with expanding combusted gases for power driving of these pistons. Even after the power piston and its cylinder pass the outlet port from the combustion chamber, the gases in each of the cylinders continues to expand, and each succeeding power piston is similarly acted upon by the expanding gases to exert continuous driving force thereon to provide the drive output torque for the drive shaft. Thus, during the initial 180° cycle for the gas expansion power stroke, the adjacently disposed intake pistons are continuously filling with air which is continuously being compressed into the combustion chamber. Thus, the initially ignited air-fuel mixture burns continuously in the combustion chamber throughout the engine's operation, requiring no need for further new ignition until the engine is shut down and restarted. The combination of the continuously expanding gases transferring from the combustion chamber to the power pistons and the impetus of the intake air pressure on the intake/compression pistons provides an essentially novel, continuous and output drive pressure to the output shaft.

The engine is a multi-fuel engine which can be operated with a carburetor or a fuel injector using almost any grade of fuel oil, gasoline, or other liquid fuel and is so efficient that essentially any desired compression ratio can be used. A high compression ratio may be used when operating this engine with a carburetor, as pre-ignited gases would almost instantly pass into the large-size combustion chamber, thereby eliminating any adverse pressure build-up.

In another embodiment the cylinder block may have cylinder heads attached to each of the cylinder openings, and these rotate along with the cylinder block interiorly of a fixed outer housing having an inner periphery. The outlet ports extend longitudinally to the ends to which a circular plate is attached, and these revolve against a fixed end plate which has a sliding, sealing contact therewith to open and close the ports. The engine may be made in a variety of different embodiments for use as an external combustion engine, a fluid pump or motor, a gas compressor, a gas compressor in combination with an exterior combustion burner for jet propulsion, a vacuum pump or any combination thereof.

The high economy of this engine is attributable to (1) the long duration of the burn which provides for more complete combustion, (2) the continuously heated walls of the one central combustion chamber which reduces heat losses, (3) the fact that the power expansion pistons have commenced their downstroke before the heated gases enter the cylinders, thereby giving less time for the relatively cooler walls thereof to dissipate the heat needed for power, (4) the saving of friction and power loss in not having to convert reciprocating motion into rotary motion, and (5) the predominant fact that a longer lever extracts a greater percentage of the energy derived from the burning of the fuel. The engines hereof are designed to meet the emission standards set by the U.S. federal government.

BRIEF DESCRIPTION OF THE DRAWINGS

The foregoing and other objectives and advantages will become further apparent to those skilled in the art by the unique construction, combination and arrangement of parts to be further hereinafter described in more complete detail and to be defined in the appended claims, reference being had to the accompanying drawings forming a part hereof. The drawings are merely for the purpose of illustrating some preferred embodiments of my invention, it being expressly understood, however, that various alterations and modifications may be made in practice of the invention within the scope of the claims and without digressing from the inventive concept hereof.

FIG. 8 is a perspective exploded view of the hex drive shaft and certain related components.

FIG. 17 is an enlarged diagrammatic transverse view through an engine of this type but having 8 pistons and cylinders, instead of 6, and showing the flats of the rotary drive shaft advanced with respect to the pistons and piston chambers.

FIG. 20 is a plan diagrammatic view of a modified bi-chambered combustion chamber respectively having fluid transfer ports for connection with separate banks of power pistons as viewed on line 20—20 of FIG. 21.

FIG. 21 is an elevational view of the chamber of FIG. 20.

FIGS. 22 and 22A are side and end elevational views of a further modified combustion chamber being of an elongated cylindrical form with a frustoconical fluid delivery portion at one end.

FIG. 23 is an axial cross-sectional view through a simplified singlebank twin cylinder form of the invention.

FIG. 24 is a transverse cross-sectional view seen substantially on line 24—24 of FIG. 23.

FIG. 25 is a longitudinal cross-section through a further modified embodiment of this invention showing a 2-bank, 2-cylinder out-of-phase arrangement.

FIG. 26 is a transverse cross-sectional view through a part of the foregoing embodiment and as seen substantially on line 26—26 of FIG. 25.

FIG. 41 shows a bridle ring supporting the T of two base plates.

FIGS. 42, 43, 44, and 45 show the construction of a piston.

FIG. 46 shows the details of sealing the joints of the rings and vanes.

FIG. 47 shows the details how joints are slotted to fit the rings..

FIG. 48 shows how the joint is slotted to fit the vanes. FIG. 49 shows a modification of the engine with the ports extending out at the ends.

FIG. 50 shows the stationary plate with its rings and vanes that seals against the plate in FIG. 49.

FIG. 51 shows a piston made in an oblong form.

DETAILED DESCRIPTION OF THE PREFERRED EMBODIMENTS

Figure 1:
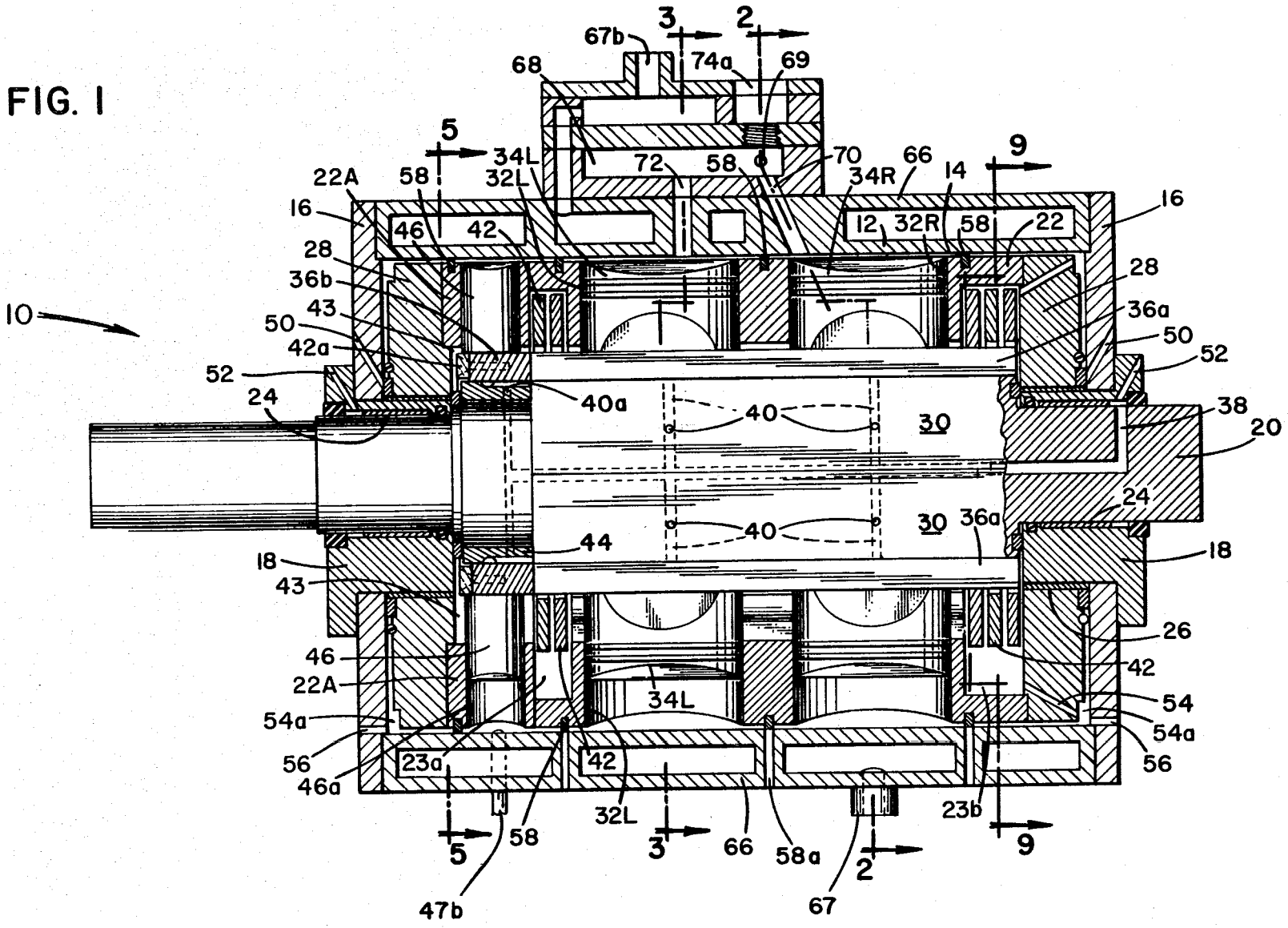
FIG. 1 is a longitudinal cross-section through one embodiment of the invention of this application, with certain parts shown in elevation.
Figure 3:
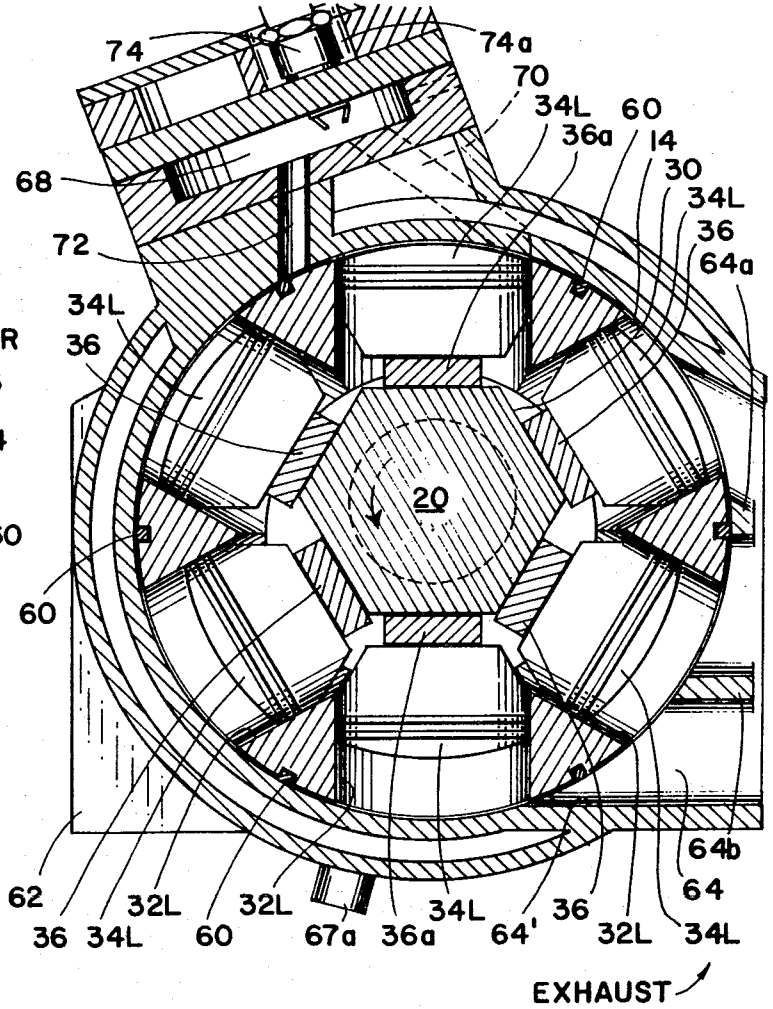
FIG. 3 is a similar transverse cross-sectional view, but taken substantially on line 3—3 of FIG. 1.
Figure 2:
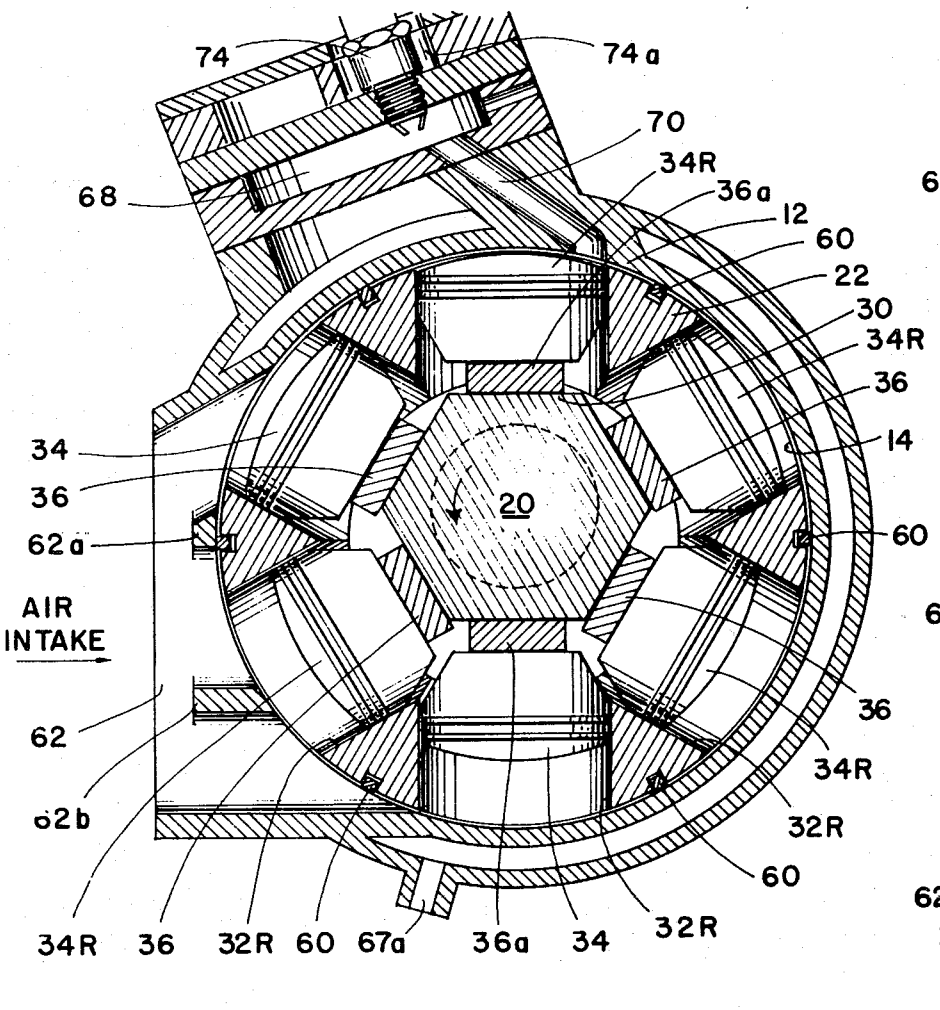
FIG. 2 is a transverse cross-sectional view taken substantially on line 2—2 of FIG. 1.

Referring in more detail to the illustrative form depicted in FIGS. 1-16, the basic 2-bank, 12-cylinder (6 cylindners per bank) external combustion engine is designated generally at 10. Referring more particularly to FIGS. 1-3, it will be seen that the engine has relatively few moving parts including the rotary cylinder block with pistons and eccentric rotary drive shaft which are operatively interconnected and move generally circulary within the generally cylindrical stationary outer housing 12. The center axes of the housing 12 and rotary cylinder block 22 are coaxial. Housing 12 has a cylindrical internal wall surface 14 and transverse parallel opposite end walls 16, 16 each provided with an axially centered aperture to receive aligned bearing sleeves or bosses 18, 18. Bearing bosses 18, 18, in turn, are eccentrically apertured to receive the cylindrical ends of the rotary drive shaft generally designated 20. The axis of the rotary drive shaft 20 is parallel to but axially offset from the common axis of the housing 12 and the rotary cylinder block 22. This eccentric relative relationship determines the throw of the pistons, since the pistons are operatively engaged by the drive shaft.

The bearing bosses 18 are provided with a main inner bushing or bearing sleeve 24 rotatively supporting the ends of the rotary drive shaft 20, and further provided with an external main bushing or bearing sleeve 26 for rotatively supporting the rotary cylinder block 22 by means of appropriate bearing apertures provided in the axial center of its transverse end walls 28.

The rotary cylinder block 22 is of generally cylindrical form having a substantial open central passageway, and whose outer cylindrical surface has a complemental rotary sliding fit with the internal wall surface 14 of the stationary housing 12. The open center is to receive the eccentrically disposed rotary drive shaft 20 having a preferably uniformly hexagonal medial cross-section upon whose planar surfaces 30 the engine pistons 34 are operatively mounted. In this embodiment, the rotary cylinder block 22 is provided with two axially spaced banks of six piston chambers each. The chambers 32 are preferably but not necessarily of circular cross-section. It is conceivable that the cross-section of the cylinders and corresponding pistons could be of generally oval or eliptical cross-section or even approaching the somewhat generally rectangular form. Each cylinder is occupied by a complementally formed piston 34 having relatively short piston travel.

As illustrated in FIG. 1, the right-hand bank represents the intake/compression cylinders of which the cylinders are designated 32R. The left-hand bank represents the power/exhaust cylinders designated 32L within which corresponding pistons 34L are respectively disposed. In this form the chambers and pistons preferably are uniformly circumferentially spaced apart every 60° in a radial manner about the axis of the rotary cylinder block.

Each pair of adjacent pistons 34L and 34R are connected rigidly at their respective bases to and supported by an elongated base plate 36. Base plates 36 are of less cross-sectional width than the width of the corresponding flat or planar surface 30 of the hexagonal drive shaft, to enable the plates to slide freely from side to side thereon during eccentric rotation of the rotary drive shaft and rotary cylinder block. Means including lubrication channels 38 disposed within the shaft 20 provide for appropirate lubrication as well as partial cooling of these relatively movable base plates upon the hex shaft, to be described in greater detail hereinafter.

Diametrically opposed pairs of the pistons 34 and their slidable base plates 36 are interconnected near each longitudinal end by an endless preferably curvilinear, generally oval-shaped bridle ring 42, (FIGS. 1 and 9–12) whose internal surfaces may be notched to complementally lock upon the generally rectangular cross-sectional base plates 36. The opposite end portions of the basic rotary cylinder block 22 are provided with suitable annular recesses 23*a* and 23*b* to accommodate the bridle rings 42. Means other than the specific bridle rings means may be devised to interconnect opposed pairs of the piston-mounting base plates. In the FIG. 1 form of this engine, the arrangement of one of the bridle connecting rings 42*a* (FIGS. 1 and 5) will be somewhat different than that for the other bridle rings, as will be described hereinafter.

The one-to-one ratio of the rotating cylinder block 22 and the rotary drive shaft 20 is controlled partially by means now to be described. Said means includes a generally rectangularly-shaped, centrally apertured block 44 attached to the rotary drive shaft 20 forwardly of its hex portion (FIGS. 1, 5 and 8), which collectively form a generally T-shaped appearance and, accordingly, will be designated as T-block 44. The T-block 44 has opposed top and bottom surfaces which are co-planar with the corresponding top and bottom surfaces of the hex drive shaft, as shown in FIGS. 1 and 8. The means further include a pair of T-shaped piston-mounting base plates 36*a*, whose head portion 36*b* is co-planar with the rest of the plate and is of a width and depth corresponding respectively to the width and axial thickness of said T-block 44.

The bridle ring 42*a* is for attaching the opposed T-shaped base plates 36*a* together, which is this instance, unlike that of the first-mentioned bridle rings 42, is by suitable joining means, such as screw fasteners or press-fit pins 45.

Figure 5:
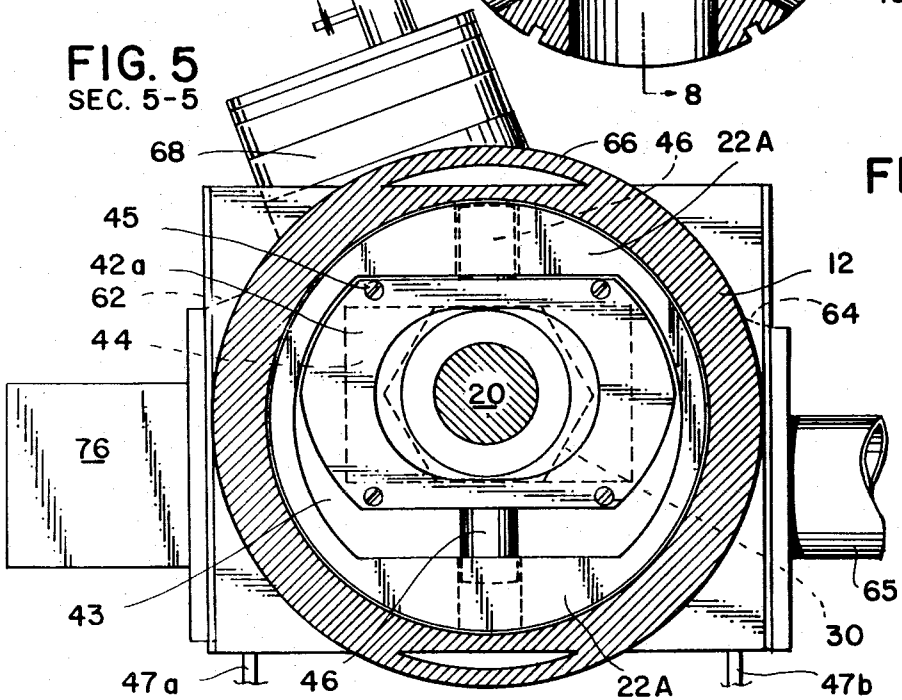
FIG. 5 is a cross-sectional view taken substantially on line 5—5 of FIG. 4.

Bridle ring 42*a* has opposed parallel top and bottom sides which are co-planar with the outermost opposed surfaces of the corresponding T-shaped base plates 36*a*, 36*a*. The other transversely opposite ends of the bridle ring 42 are shown to have symmetrical bi-arcuate convex surfaces although they may have other shapes, such as being generally squared off. There is clearance between the bridle rings and all of the components of the rotary cylinder block. As can be seen in FIG. 5, the central aperature of portion 22A is enlarged beyond the size of the bridle ring 42*a* an amount corresponding essentially to the amount of eccentricity of offset of the drive shaft. FIGS. 9 to 12 shows clearance between all of the bridle rings 42 and the aperture of the cylinder block 22.

All of the base plates 36, 36*a*, with their connecting rings 42 and 42*a* are so proportioned in relation to the amount of eccentricity of the rotary drive shaft 22 and its connected T-shape end 44 so as to assure positive smooth rotation of the composite rotary cylinder block 22, 22A with and responsive to rotary drive power applied to the rotary drive shaft 20.

The bearing mounted T-shaped base plates 36*a*, 36*a* each are shown with a smaller size guiding or pumping piston 46 fixedly attached thereto in longitudinal alignment with the pistons 34. These pumping pistons 46 are similarly operable within corresponding piston chambers 46*a* formed diametrically in the forward annular portion 22A of the rotary cylinder block 22. The smaller pistons 46 and chambers 46*a* preferably are provided with closer piston-to-cylinder wall tolerances than is provided for the main pistons 34 and their respective chambers or cylinders 32. Therefore, these pistons 46 help serve to centrally stabilize the other pistons attached to the common base plate 36*a*, and because the diametrically opposed plates 36*a*, 36*a* are tied together as described hereinabove, they collectively serve to improve the synchronized movement of these sets of pistons, and accordingly the other sets also. Therefore, in view of the aforedescribed conjoint positive rotation of the rotary cylinder block 22 and the rotary drive shaft 20, it is apparent that this arrangement permits the pistons 34 to move or float relatively freely within their respective cyliders.

Figure 7:
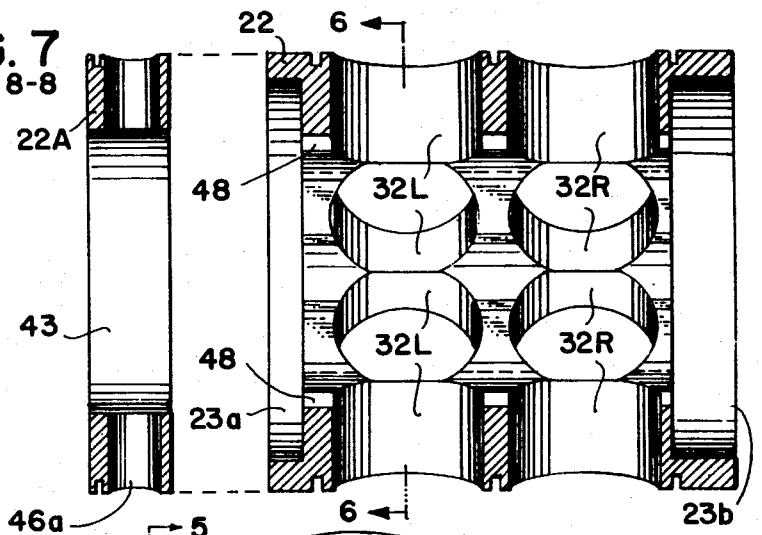
FIG. 7 is a longitudinal cross-section through the separated composite rotary cylinder block components, as viewed substantially on line 8—8 of FIG. 6.
Figure 4:
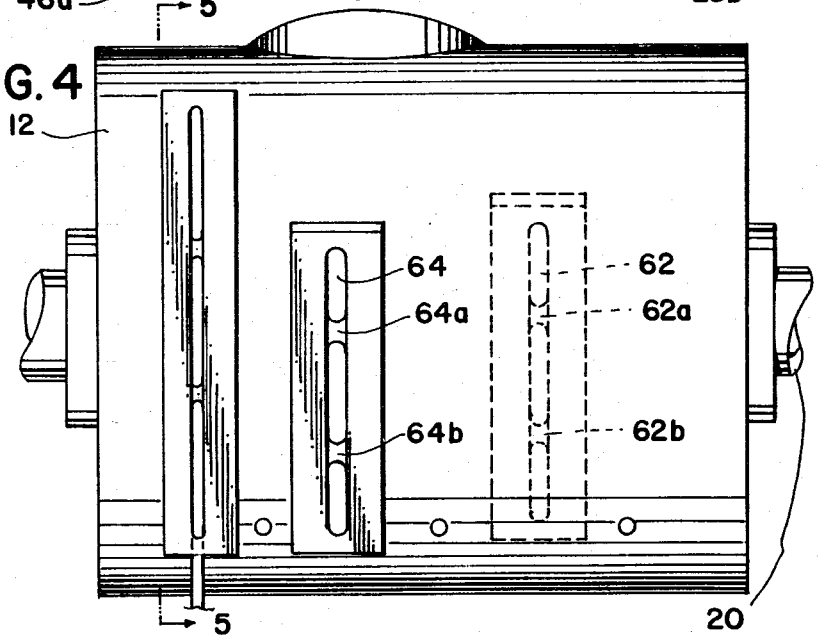
FIG. 4 is a side elevational view of the engine housing assembly without the external combustion chamber assembled therewith.
Figure 6:
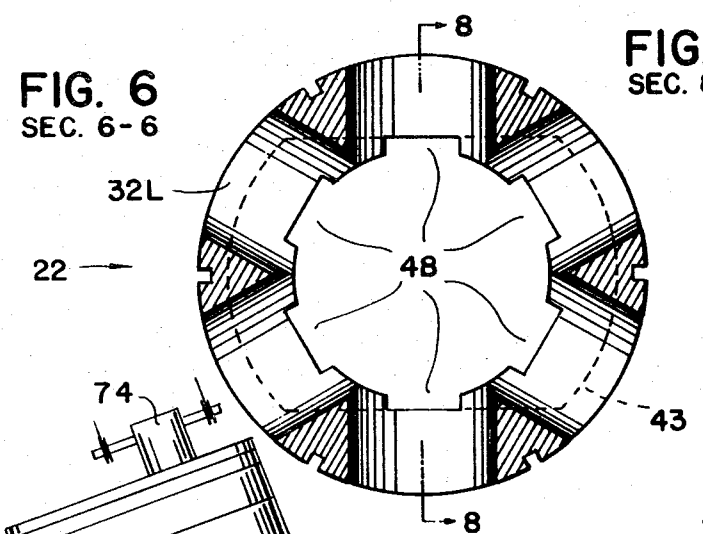
FIG. 6 is a transverse cross-section through the rotary cylinder block of the engine, as is viewed substantially on line 6—6 of FIG. 7.

Reference to FIGS. 5–7 will better show the constructional details of the rotary composite cylinder block 22, 22A. This block may be provided on its inner periphery with circumferentially spaced rectangular, base-plate-clearance notches 48 centered with the respective piston chambers 32L, 32R. These notches 48 are of sufficient transverse or circumferential extent so as not to interfere with the base plates 36 as they slide from one extreme side of the flat hex surfaces to the other, responsive to the eccentric relative rotation of the rotary cylinder block and rotary drive shaft relative to the fixed housing. Alternatively, the inner periphery of the block may be enlarged and have an unnotched generally uniform diameter.

Lubricating oil may be fed under pressure by external mounted pump means (not shown), or by the pumping pistons 46 acting as an oil pump, with appropriate outlet and return lines 47*a* and 47*b* (FIG. 5), to supply oil to the main outer bearings 26,26 through suitable openings 50,50 provided at opposite ends 16,16 of the housing. Oil under pressure is also forced via inlets 52,52 (FIG. 1, right end) into the end of the rotary drive shaft. As shown in FIG. 8, base plates 36 and 36*a* are lubricated via the branch conduits 40 opening onto the faces 30 of the shaft 20 from the longitudinal channel 38 extending substantially the length of the drive shaft 20. Oil is pumped into channel 38 from channel 40*a* in T-block 44, connected to pump pistons 46. After lubricating these planar surfaces 30 of the hex shaft and the sliding plates 36,36*a*, the oil flows out against the various pistons and the inner surface of the cylinders providing cooling for these surfaces. This oil and the oil from the main bearings 24,26 may be returned through suitable openings 54 near the outer radial portions of end plates 28 of the rotary cylinder block, passing into annular grooves 54*a* in the same end plates 28, and then exiting through openings 56 formed in the stationary housing 12 and into a suitable sump (which in some instances may be in the area of the pistons 46.)

Annular sectional spring loaded sealing rings 58 preferably are used to separate the axial banks piston chambers from one another. The sealing ring would not be necessary between adjacent banks of cylinders and pistons where the adjacent banks have equal pressure during operation. Also understood that pistons 34 are fitted with conventional annular compression rings. Additionally, spring-loaded radially extending wiper seals 60 (FIGS. 2 and 3) are provided in the rotary cylinder block and extend longitudinally between the annular sealing rings 58, and are used to separate the pressure in each of the individual cylinders of each bank. Suitable sealing rings are also used to maintain the oil pressure around the main bearings of the shaft.

The annular sealing rings 58 receive a supply of oil in any suitable manner, as by openings 58*a* provided in the bottom of the main housing 12. Excess oil escaping past the compression rings of the pistons 34 will lubricate the radial wiper seals 58 as interposed between each cylinder.

By the provision of the T-block 44 and the longer sliding T-shaped base plates 36*a*,36*a* with their greater collective area, there is provided a more positive radial rotational thrust between the pistons 34,46 mounted thereon and the drive shaft, but also inherently and effectively between the other plates and their respective pistons and the drive shaft.

Because of the extensive flat area of the rotary drive shaft surfaces 30 together with the extensive flat area of the piston base plates 36,36*a*,36*b* each piston employs the total bearing surface during its heavier load while each adjacent piston is carrying a much lighter or neutral load. That is, the bearing surface of the base plate employs the whole surface in common and serves each piston alternately. By each set of diametrically opposed power pistons 34L being connected by the bridle rings 42, the torque action of all of the power pistons is directed against the diametrically opposed pistons in their respective exhaust strokes and the adjacent compressor pistons 34R in their compression strokes. Also, the use of the interconnecting bridle rings 42 for each set of opposing pistons provides an inherent guide means for each other as well as an integral rotational balance.

The change from the type of reciprocating motion in conventional engines to that in conjunction with the true rotary motion in the present engine, has greatly reduced the bearing load on the hexagonal shaft surfaces 30 and the main bearing 24,26. All of the pistons are balanced by the interconnecting bridle rings with the opposed pistons providing a unit balance relieving additional bearing load upon the rotary drive shaft 20.

One side of the fixed outer housing 12 is provided with a suitable intake port 62 (FIGS. 2,3, and 4) of elongated vertical form preferably so as to communicate simultaneously with at least portions of two or three of the intake/compression cylinders 32R and pistons 34R, as can be discerned from FIG. 2. The elongated intake port or opening 62 is defined by rigid vertical side walls and transverse top and bottom walls forming a suitable outward face to which a carburetor 76 or a control valve may be connected. The opposite side of the housing 12 is provided with a similarly formed exhaust outlet 64 in alignment with the bank of power/exhaust cylinders 32L to which an exhaust manifold pipe 65 may be attached. Portions of the side walls of both ports are connected by vertically spaced cross-tie portions 62*a*,62*b*,64*a*,64*b* which help preclude warping of the elongated exhaust port from heat generated during engine operation.

Additionally, the main housing 12 is provided with a water cooling jacket 66 surrounding the housing to form suitable passages through which to circulate the cooling water or other liquid. Water enters through an inlet 67*a* at the bottom and circulates around both sides and top of the engine, there being provision for circulating it up and at least partially around the external combustion chamber 68. The water then exits from a top outlet 67*b* (FIG. 1) and is recirculated by a suitable water pump (not shown) passing en route through a suitable cooling radiator, also not shown. Conventional heat and pressure controls (not shown), would be used in conjunction therewith in a known manner.

The combustion chamber 68 in one form (FIGS. 1, 2 and 3) may be of generally circular plan form. The illustrative generally rectangular cross-section thereof is provided with a fuel inlet or injection port 69 (FIGS. 1–3), when a fuel injection system is preferably used, and is disposed to introduce pump-forced fuel in a generally tangential and preferably continuous manner. Radially opposite the respective banks of cylinders 32, the housing is provided with fluid transfer ports 70 and 72 for communicating with the combustion chamber 68. Transfer port 70 represents the passageway for directing the compressed air from the intake/compression bank of cylinders 32R and pistons 34R into the combustion chamber 68. The port 70 is disposed so that the air, like the fuel, is introduced in a tangential manner whereupon the centrifuge-like spirally flowing mixture of air and fuel is initially ignited by a suitable igniter means 74 and thereafter burns in a continuous flame. Accordingly, the interior of the combustion chamber does not cool down periodically. The flow of air-fuel mixture entering the combustion chamber 68 is continous once operation commences, therefore resulting in the continuous burning within the combustion chamber to ignite the successively incoming mixture. The centrifuge-like action contributes to a more complete combustion, whereby the cooler and relatively heavier parts of the mixture are retained in circumferential motion along the outer walls long enough to burn more completely, while the hotter and lighter parts having burned more thoroughly move inwardly toward the centrally disposed outlet transfer port 72 (FIGS. 1 and 3). The expanding gases exit the port 72 to impinge upon the power pistons 34L (FIG. 3) for the power cycle.

The power cycle is the same for both the carburetor and fuel injection type engines. An important feature of the unique constructional relationship of components is that, as the power cylinders 32L pass the top dead center position, there is relatively little radial movement of the power pistons 34L during the slight interval of time before the cylinders 32L open into communication with the power transfer port 72. Accordingly, the potential time during which heat can be transferred to the power cylinder walls is materially reduced and contributes to more efficient expansion power to drive the pistons and rotary output drive shaft. During all of the time that the power cylinders 32L are open to the power transfer port 72, the same amount of pressure from within the combustion chamber is exerted against these power pistons 34L. This may be known as the constant pressure part of the cycle. It is apparent that the interior wall of the stationary housing is not permitted to become cool intermittently, like in other engines, due to the continuous, successive power strokes.

After each successive power cylinder 32L passes and becomes closed off from the transfer port 72, the gases trapped within each cylinder continue to expand and apply power against the piston 34L therein to provide torque to the rotary drive shaft 20 during the remainder of their 180° power cycles. At approximately the bottom dead center position, the cylinders 32L commence their exhaust cycle when they come into communication with the exhaust port 64. In a preferred form of the exhaust port, the lower portion of the exhaust port is preferably of narrowed V-form such as exemplified at 64′ in FIG. 13. Because of the arcuate inner form of the housing, the point of the V 64′ extends inwardly further at the lower portion (FIG. 3) and this portion "opens" first as the cylinder opening 32L commences to pass over the port 64, thereby more gradually releasing the exhaust gas and helping to reduce the exhaust noise. During the major part of this 180° upstroke cycle, the burned gases are forced out of the exhaust port 64 which is connected with a suitable exhaust pipe 65 shown in FIG. 5. As the power cylinders 32L approach their top dead center position again, they pass and become closed off from the exhaust outlet port 64. The relative size and disposition of the exhaust port and orientation of the rotary drive shaft enables a small amount of the nonexpelled exhaust gas to remain within the cylinders 32L to act as a buffer or cushion. This helps offset the surge of the substantial, constant gas pressure directed into the cylinders 32L after they pass the top dead center position and again come into communication with the transfer port 72 through which the expanding gases pass from the combustion chamber 68. It is apparent that the four 180° cycles, the two intake and compression cycles for the right bank of pistons and cylinders, and the other two power and exhaust cycles of the left bank, are effectively carried out synchronously during each 360° revolution of the rotary cylinder block 22 and the drive shaft 20.

It is understood that conventional forms of starter mechanisms and heat exchangers, may be provided in conjunction with this novel engine, as will be briefly mentioned hereinafter in relation to alternative embodiments.

OPERATION

Before proceeding in detail to modified embodiments, a brief summary of the operation of the foregoing engine, which always embodies an even number of pistons per bank, will be made.

As stated before, the engine can be operated either with a carburetor or fuel injection system. In FIG. 5 a suitable carburetor 76 is shown attached to the intake port 62. More preferably a fuel injection system is used, with air being introduced into and drawn through the intake port 62, which air is then compressed and introduced into the combustion chamber 68 simultaneously with continuous injection of liquid fuel through the fuel inlet port 69 (FIG. 2).

To commence operation of the engine, a starter key (not shown) is turned on in a conventional manner closing an electrical circuit (not shown), deriving electrical energy from a conventional storage battery whereupon a starter motor (not shown in FIGS. 1–3) operatively connected with the rotary drive shaft imparts rotation thereto. Simultaneously the power source and circuit provide power to the igniter means 74, located in opening 74*a* (FIGS. 1,2, and 3), and effect operation of a fuel pump (not shown). When the fuel and air mixture reaches the igniter arc, initial combustion commences building up pressure within the external combustion chamber 68 and thereafter exerting a continuous or constant pressure to the power pistons 34L to effect engine operation. The return of the starter key to the "off" position serves to disengage the starter motor and the circuit with electric arc inasmuch as once the combustion has been started it results in a continuously burning flame within the combustion chamber thereafter as long as engine operation is continued. To stop the engine, the key will be merely turned to a "stop" position which will serve to shut off the fuel flow at either the injector or the carburetor as the case may be.

The starting of this engine is unique in that there is not the usual compression buildup. Combustion begins within the combustion chamber 68 at nearly atmospheric pressure. The continuous flame prevents stalling, and provides better conditions for acceleration. As mentioned before, the power cycles will be the same for both the carburetor and fuel injection type engines. Commencing at the top dead center position, the intake pistons 34R initially move only a relatively short radial distance thereby allowing any residue of pressure from the previous compression stroke to expend itself at or below atmospheric pressure before the intake port 62 is reached and thereafter "opens" to initiate intake of the fresh supply of air. During the intake stroke, the pistons 34R move radially inwardly as the shaft and cylinder block 22 rotate, and the cylinders 32R are filled with the air in an amount which may be controlled by a valve similar to that of the butterfly valve in a carburetor intake pipe. When using a conventional type carburetor the amount of air-fuel mixture allowed into the cylinders 32R is controlled by the throttle or other similar means which operates the valve of the carburetor. The amount of mixture directed into the cylinders 32R controls the pressure in combustion chamber 68.

Figure 18:
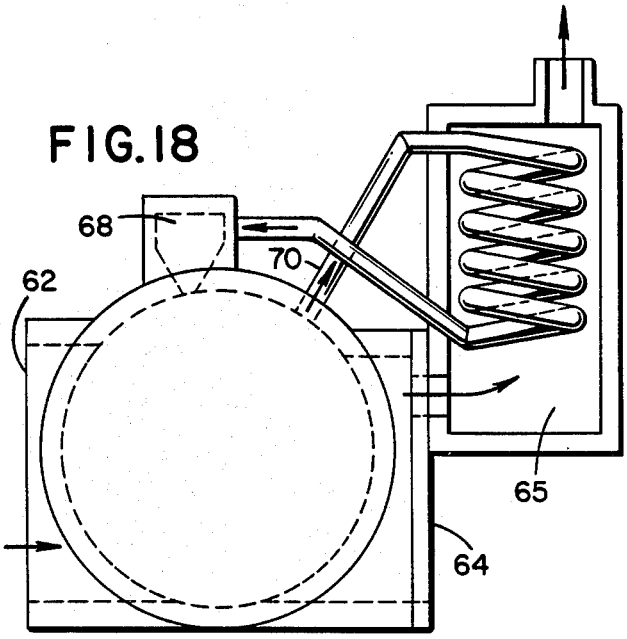
FIG. 18 is a diagrammatic and elevational view of an engine of this invention shown with a heat exchanger assembled therewith.

As depicted in FIG. 2, at least portions of two or three of the intake compression cylinders 32R are able to be in communication with the intake port 62 at a given time. During the intake stroke the cylinders are filled with air, and approximately as they reach and pass bottom dead center they are closed off from the intake port, and the air trapped within the cylinders 32R is compressed during the upstroke or compression stroke until said cylinders come into communication with the outlet transfer port 70. As will be described in greater detail hereinafter, it is to be understood that there can be two or more such transfer ports, which in some embodiments may be controlled by suitable pressure relief valves, and so located as to be able to vary the compression ratio. The compressed air is forced through the transfer port 70 and into the combustion chamber 68 by the remaining part of the compression stroke. The air can also be directed through a heat exchanger 65, shown diagrammatically in conjunction with FIG. 18, whereby the exhaust heat from the engine is utilized to pre-heat the incoming air before it reaches the combustion chamber. The position of the outlet transfer port 70 will be determined by the desired compression ratio. The compressed air enters the circular combustion chamber 68 in a tangential manner to impart a circular motion thereto within the circular chamber. The fuel is simultaneously being continually injected in a similar manner to enhance the centrifugal motion of the mixture which then burns with a continuous flame following the initial ignition. The centrifugal action working upon the burning mixture separates the heavier parts thereof and holds them toward the outer peripheral wall while the lighter and greater expanded gas is more thorougly burned near the center of the spiral and is directed out the centrally disposed expansion or transfer port 72 to produce torque on the power piston bank during the expansion cycle. The cooler and heavier parts of the mixture remain circulating around the outer part of the combustion chamber 68 until they burn more completely thereby reducing the hydro-carbon emissions and providing improved efficiency and economy. Because of the continuous combustion flame within the external combustion chamber 68, the walls thereof remain continuously warm and heated and do not tend to cool down intermittenly as in conventional engines. In conventional engines the cylinder walls, by comparison, would be considered relatively cooler because they are heated only intermittently by the flash spark plug ignition once between the three other cycles of exhaust, intake and compression.

Figure 15:
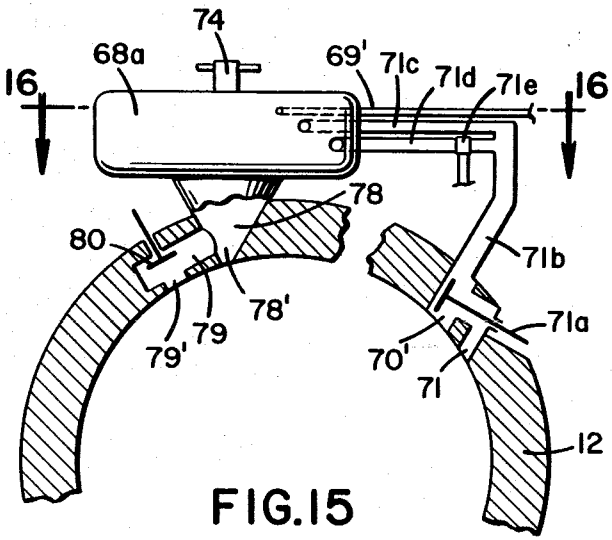
FIG. 15 is a semi-diagrammatic fragmentary elevational and cross-sectional view of a modified form of the invention.
Figure 12:
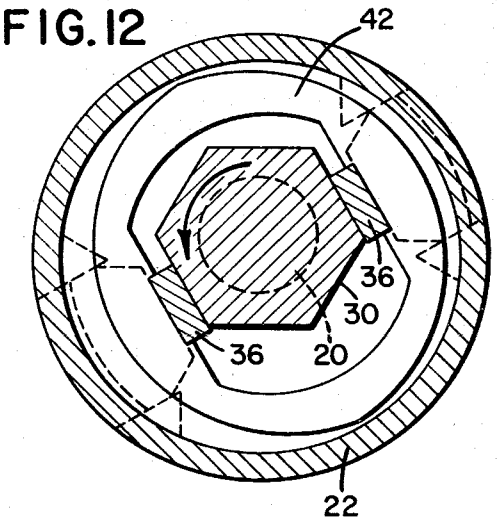

It is contemplated in some embodiments, such as FIG. 15, that additional inlets for the air may be provided leading into the combustion chamber. In this manner the initial combustion can commence with a richer mixture and the additional inlets can be used to subsequently lean the mixture as desired progressively throughout the burning cycle. This will be described in more detail hereinafter. As the cylinder openings of the power pistons 34L move across the outlet end of the combustion transfer port 72, the gas pressure which has built up within the combustion chamber 68 is exerted in a continuous and constant manner against these pistons, thereby providing constant torque pressure to the pistons 34L to drive the rotary drive shaft and rotary cylinder block.

The driving force of the pistons 34L are responsible for imparting rotation to the rotor or rotary drive shaft 20, and it is not the rotating cylinder block 22 which rotates the shaft. However, the rotating cylinder block must be maintained in its correct position relative to the rotary shaft so that the bearing surfaces of the respective piston lay flush upon the planar bearing surfaces of the polygonal shaped portion of the drive shaft. The rotary cylinder block assures proper positioning of each piston to exert its torque imparting leverage perpedicularly against the flats of the shaft. Due to the eccentric relationship of the shaft, the amount of leverage applied thereto changes continuously as the distance of the axis of each piston varies in relation to the center of the said rotary drive shaft. It is understood that each piston is exerting a driving force down along its axis onto the particular lever advantage it has upon the rotary drive shaft during all respective positions between its substantially top and bottom dead center positions. The additional smaller, closer fitting guide pistons 46 may be used with their more precise alignment so that the main pistons 34 will not need to impart side pressure upon their cylinder walls, and thus they will be enabled to maintain a more central position and relieve some wear and friction.

It is contemplated that a port equivalent to port 72 may be controlled by a valve, such as by valve 80 in FIG. 15, to be described hereinafter. It is also contemplated that one or more additional ports can be provided in a location further in the power cycle which would extend this constant pressure segment and provide for additional torque.

After the power cylinders 32L pass the transfer port 72, the gases trapped within the piston chambers continue to expand driving the pistons downwardly therein and via their connection with the slidable base plate 36 apply torque to the hex drive shaft 20 until they reach approximately bottom dead center position. At this time the cylinders 32L pass into communication with the exhaust port 64, the lower portion 64' of which when made in the shape of a long narrow V as described hereinabove, thereby facilitates a gradual release of the exhaust gas pressures and a decrease of the exhaust noise. The exhaust port 64 is of a predeterminable size such that the power/expansion pistons and cylinders can stay in communication therewith until nearly top dead center position. The relative size of the exhaust port can be varied, and/or the relative disposition of the shaft can be varied, so that the cylinders 32L can be made to close earlier or later. If made to close earlier, it would provide more gas pressure being retained within the said cylinders to help cushion the incoming and new combustion pressure as the cylinders pass top dead center and again come into communication with the transfer port 72. The power and exhaust cycles of the left bank or pistons and cylinders inherently simultaneously provide the necessary and synchronous rotation for the right bank of intake/compression pistons and cylinders whose two 180° cycles run synchronously with those of the power exhaust cycles for each 360° revolution of the rotary housing and drive shaft. Thus, it is apparent that a smoothly running engine providing constant power and pressure to the power pistons is provided by this unique engine.

CONTEMPLATED GENERAL MODIFICATIONS

The engine can be used in a combination of several banks serving as additonal power output banks, air compressor banks, or other potential uses. The unit also may be built with one or more stages of plural compression banks or the angularly spaced cylinders in any given bank may be divided into two or more stages of compression. Additional units, for various purposes, may be placed in tandem with a common drive shaft extending through the aligned units. It is also contemplated that the engine can be used with a combination of a fluid pump or motor with an additional set of the pistons and cylinders being axially spaced from the others and with the inlet and outlet port being connected for an auxilliary fluid service and/or be used as a fluid pump or motor.

Figure 14A:
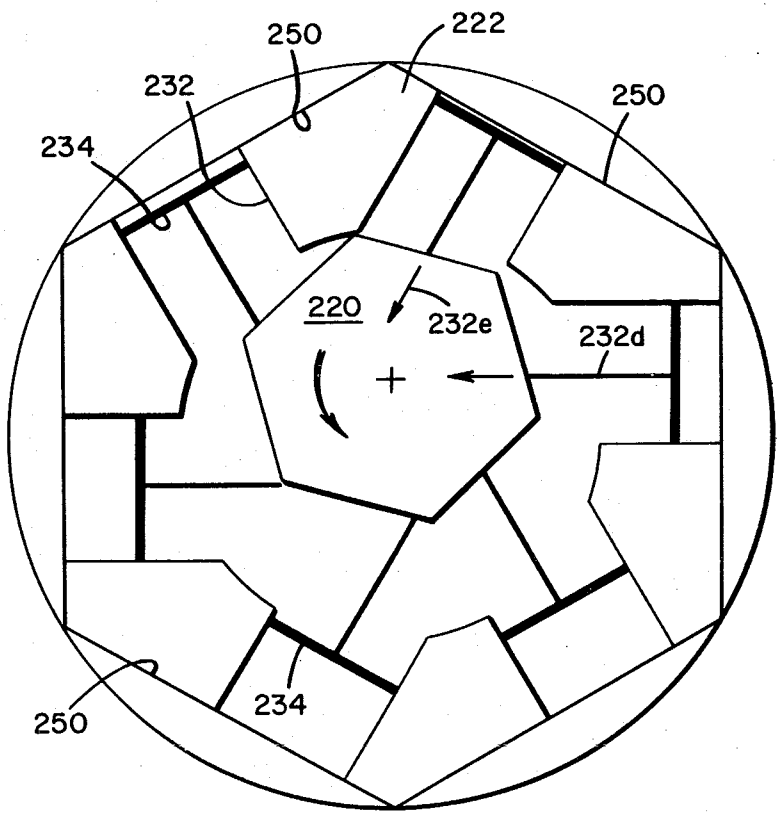
FIGS. 14 and 14A is an enlarged diagrammatic transverse view of the engine of this type showing the flats of the rotary drive shaft advanced as shown in FIG. 17 and also with the pistons and the piston chambers advanced.
Figure 14:
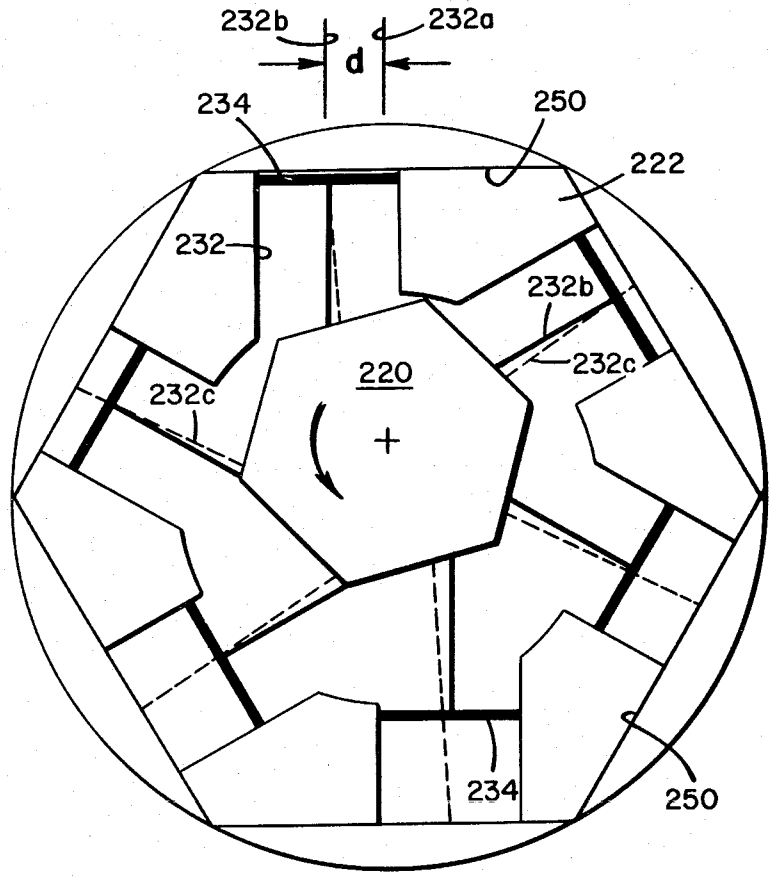

FIGS. 14 and 14A show a semi-diagrammatic illustration of an important modification of the device used for various purposes. Not only is the pologonial shaft 220 advanced from that shown for shaft 20 in FIG. 12, but also the cylinders are advanced. The axis of one cylinder is advanced at top dead center from the line of centers between the piston and shaft **232*a*, where it intersects the axis of shaft 220, to 232*b*, where it is displaced therefrom by the distance d in FIG. 14. This same advance is shown in a 90° revolution in FIG. 14A. The axis of the cylinders can also be toed-in at 232*c* with respect to 232*b*, and this is preferable to keep the base plates 36 in a closer relation to the face of the pologonial shaft 220, as shown, when the pistons 234 have retracted inwardly in their strokes. The purpose of the arrangement is to give the gas pressures within the cylinders a greater lever advantage on the shaft 220**. At top dead center in the usual engine there is no leverage, but in this arrangement there is a large amount of leverage when the power of the gas pressures in the cylinders are at their maximum, and this extra length of leverage beyond that of ordinary engine continues throughout the length of the stroke. And this advantage can be compounded by adding two or more banks of cylinders with each set being directly connected together by a port or ports, so that each set of two or more cylinders acts as one unit. Empirical testing may dictate the amount of cylinder and shaft advance, and the amount of toe-in of the cylinders, or the number of banks to be used.

The use of these same features has an advantage in its application for use as an air compressor. As shown in FIG. 14A at the 90° point of compression the axis 232*d* of the cylinder does not have any lever action upon the shaft 220, thus the off-set of the shaft 220 is relation to the rotating cylinder block 222 is doing all of the pumping action. At 135° of rotation, the angle of 232*e* even reduces the off-set leverage when the compression pressures are at the highest. Emprical testing may be needed to determine the most advantageous position of each feature. Lines 250 are heads.

Figure 28:
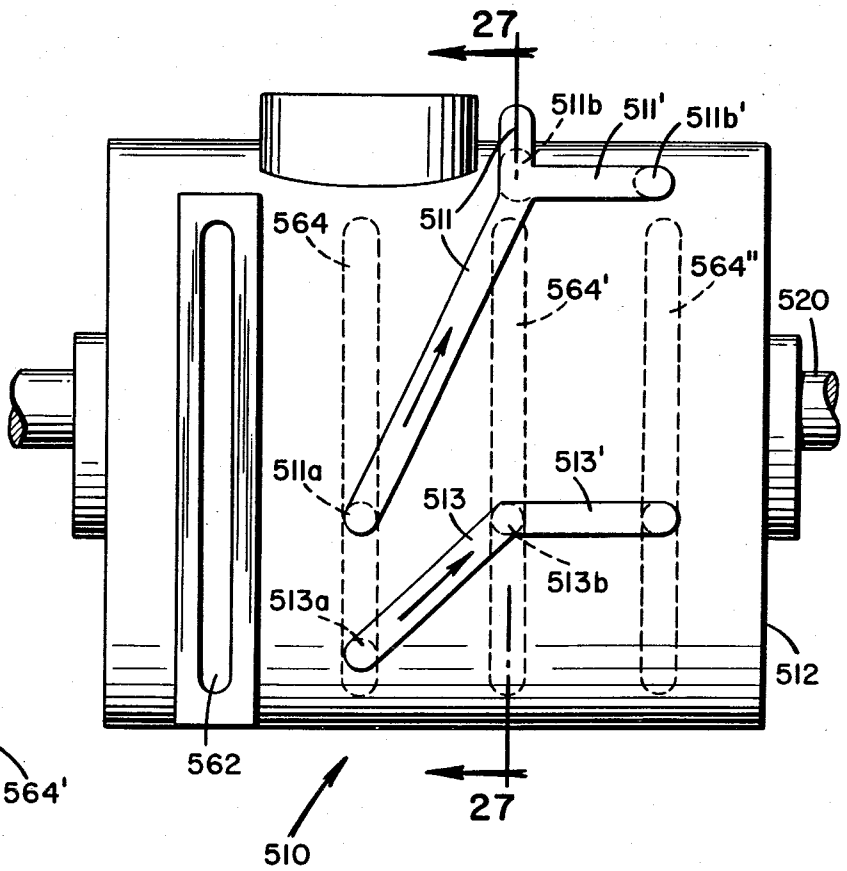
FIG. 28 is an elevational view of the modification of FIG. 27, as seen on line 28—28 of FIG. 27.

When two or more power banks are used, the maximum pressure should be opened by ports so that all of the increased lever action acts on all the pistons at once rather than in a delayed form as shown in FIG. 28. The longer oblong piston of FIG. 51 would accomplish the same purpose.

Figure 19:
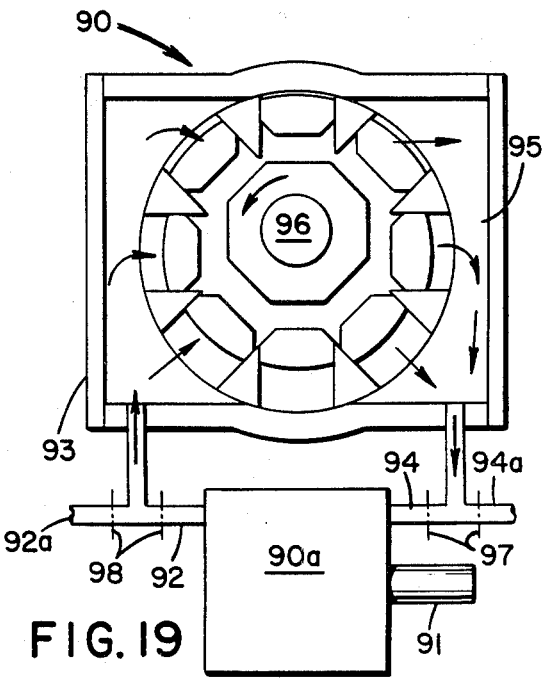
FIG. 19 is a diagrammatic view of an illustrative hydraulic starting means combined with a hydraulic starter means.

FIG. 19 is an example of an additional bank of cylinders 90 functioning as a hydraulic pump which is directly connected to the drive shaft 20 of the engine shown in FIG. 1, for example. By driving the pump 90 with an auxiliary starting pump 90*a*, the external combustion engine of FIG. 1 can be started. To start the engine with the auxiliary starter pump 90*a*, the fluid enters through conduit 92 into the left side of the housing 93 and applies pressure against the pistons, imparting starting rotation of the shaft 96. The hydraulic fluid is expelled into the area on the right side of the housing 95 and returns through conduit 94. After the engine is started the unit 90 can be used as a hydraulic pump with the hydraulic fluid flow being pumped out through conduit 94*a* by closing and opening valves 97 and the fluid will return to the unit through conduit 92*a* by closing and opening valves 98.

While a hexagonal type drive shaft with 6 cylinders per bank has been exemplified thus far, except in FIG. 19, alternate constructions may include as many as two, four and eight or more cylinders. Some of these contemplated modifications and other related facet changes will now be described in more detail.

MODIFIED T-BLOCK EMBODIMENTS

One modification relates to that of the T-block 44 and also to guide pistons 46. The T-block construction may be adapted for both end portions of the shaft including double T-shaped base plates for the pistons and if preferred, a duplicate set of the guide pistons 46 therewith.

Alternatively, the T-block construction may be omitted altogether or when it is desired guiding pistons 46 may be provided for all the base plates. For such an embodiment, it is understood that the reciprocating, piston-mounting base plates 36 would be of somewhat greater length depending upon whether there is to be a full set of the guide pistons 46 mounted toward each end of the polygonal cross-sectional drive shaft.

MODIFIED COMBUSTION CHAMBERS

Figure 16:
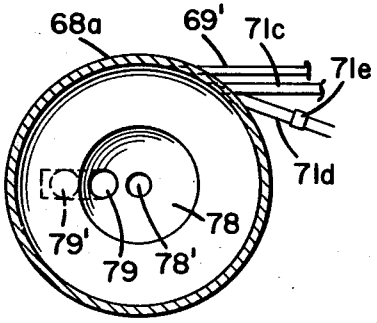
FIG. 16 is a semi-diagrammatic plan view of the combustion chamber of FIG. 15 as viewed on line 16—16.

While it is believed that the engine will run effectively with most any type of combustion chamber, one of the preferred alternate combustion chamber designs as shown in FIG. 15 and 16 may include frusto-conical shaped funnel-like central portion 78. The figures are semi-diagrammatic illustrations and include a fuel line designated 69′ and the main or first air inlet 71*c* into the combustion chamber 68*a*. The funnel-like center portion 78 helps to perpetuate the centrifuge-like action of the burning gases to provide a more complete combustion from the chamber 68*a* before entering through the port 78′ into the engine and against the bank of power pistons. Another modification is to provide an alternate passageway 79 through port 79′. The use of this port 79′ is determined by the use of the control valve 80. Preferably the combustion chamber 68*a* and the passageway 78 is to be mounted above the housing 12 so as to better protect the housing from the heat of the combustion chamber.

Additionally, this and other embodiments may include one or more optional air inlet lines 71*d* to selectively vary the air-fuel mixture, as also represented in FIGS. 15 and 16. Passage 71*b* divides near the combustion chamber to provide the first air inlet 71*c*, and a second air inlet 71*d*, the latter having the optional control valve 71*e* to be selectively opened to divide the air flow to control the rate of the mixing of the air and the fuel. As exemplified at FIG. 15, a rich air-fuel strata is introduced in the upper portion of the combustion chamber 68*a*, which strata may be leaned in subjacent strata therein by the one or more additional air inlets 71*d*.

Another optional embodiment includes an auxiliary fluid transfer port 71 for the compression bank circumferently spaced but operatively connected in relation to the basic compression port 70′, so that when the control valve 71*a* is open (FIG. 15), the compression pistons not shown will begin forcing air through the conduit 71*b* at a lower pressure for a lower compression ratio, but when the valve is closed the air will be raised to a higher pressure for a higher compression ratio. The use of a valve at the intake port during the intake cycle would accomplish the same purpose, but the amount of air would be restricted, however in this modification the volume of air is not decreased for the lower compression ratio.

A further modified dual chambered combustion chamber 68″ is illustrated in FIGS. 20 and 21. It comprises adjoining intersecting chambers of basically the same construction as shown in FIGS. 15 and 16, except that part of the cylindrical walls 68″ are modified as shown in FIG. 20, with the mutually intersecting portions forming a pointed wall 68′. The respective fuel-air inlet lines 69*a* and 71*c*′ are disposed in the middle of the common elongated side wall 68*b* directly opposite the pointed wall 68′. In this manner, incoming mixture is bisected by the pointed wall 68′ whereby the divided mixture is tangentially circulated in opposite directions within the respective chambers, with the burned gases exiting their respective funnel shaped dual outlets 78″, the latter of which may be directed against respective dual banks of power pistons 34″. As in the basic form of FIG. 15, the air and fuel enter the top portion in a tangential manner, with a conical portion contributing to increasing the rapid circular or spiral motion creating a type of jet stream. The ever-increasing descending spiral flow improves the separation of heavier and lighter parts of the mixture for more complete combustion.

A still further embodiment of the combustion chamber is shown in FIGS. 22 and 22A. The elongated cylindrical chamber designated 82 provides a thorough mixing of air and fuel. A frusto-conical portion 84 is connected in depending fashion from the end of cylinder 82 remote from that into which the air and fuel mixture is introduced through conduits 71*c* and 69, respectively. The portion 84 is adapted to function like that of the previously mentioned portions 78, 78′ and 78″.

EIGHT CYLINDER ADVANCED ROTARY DRIVE SHAFT MODIFICATION

As briefly mentioned hereinabove, a further preferred form of the engine is one, such as diagrammatically depicted in FIG. 17, in whch the drive shaft 120 is positioned so that the planar flat surfaces 130 are advanced beyond their perpendicular relationship to the axis of the corresponding pistons 134 and piston chambers 132. This arrangement will provide for an accelerated power/exhaust cycle and an accelerated air intake/compression cycle.

Referring in more detail to FIG. 17, an octagonal cross-sectional drive shaft 120 with eight cylinders 132 and pistons 134 per bank is shown. When the rotor or rotary drive shaft 120 is advanced as stated hereinabove, the piston-mounting reciprocating base plates 136 are of modified forms so as to have a non-rectangular cross-section whose opposed major planar surfaces are not parallel as they are in the aforedescribed embodiment of FIGS. 1–3.

The amount of advance of the shaft 120 may be varied for different desired performances, and may vary preferably within a range of from 0°–15°. One preferred advanced setting of 11° in the counter-clockwise direction of rotation ahead of center has been found very acceptable. This setting assures a more rapid movement of the pistons 134 within their chambers 132 under power. This assists in the displacement of the burned hot gases which saves on heat loss, decreases the time for heating up of the cylinder walls, and thereby increases efficiency. This difference of travel is illustrated by comparison to the dotted line position marked 175 in the 90° counter-clockwise position for the intake or power stroke, which dotted line shows a lesser inward stroke at this particular 90° position for pistons using a non-advanced disposition of the shaft. FIG. 17 is schematic and may be considered composite for illustrative purposes, with the left-hand 180° portion or cycle relating to either the intake or the power portion, and the right-hand 180° portion relating to either the compression, or to the exhaust cycle. With this advanced setting, the intake air is both introduced and compressed more quickly, or the exhaust gases are scavenged more quickly, as shown by the difference of travel of the piston as compared to the dotted line position 177 corresponding to the rotor not being so advanced.

The eight cylinder bank is demonstrated because of its convenience in illustrating the effect of shaft advancement at both top dead center and 90° positions in the same drawing, but such shaft advancement is also suitable for any of the other banks having two, four, or six cylinders per bank.

SINGLE BANK, TWO CYLINDER ENGINE

In the single bank engine embodiment depicted in FIGS. 23 and 24, the rotor or rotary drive shaft 320 of this two cylinder engine has a flattened rectangular medial cross-sectional portion with two opposed major planar faces 330 upon each of which a slidable base plate 336 is disposed. The pistons 334 are affixed to the plates 336 as in previous embodiments, and reciprocate within complementary piston chambers 332. Similar type bridle rings 335 are preferably used to interconnect the piston-mounting slidable base plates 336. One piston and cylinder are used for intake and compression, and the other piston and cylinder are used for expansion power and exhaust. The opposite ends of the dual faced shaft 320 are of cylindrical form and journaled in the same relative eccentric manner, as described in the previous embodiments, in the housing 312. The end plates 328 support the rotating cylinder block 332 in connection with the bearings around the journal 318.

In this single bank form, the rotary cylinder block 322 has a close-fitting sleeve 323 assembled for rotation therewith. In the outer periphery of the sleeve 323, suitable fluid transfer ports 319 and 329 are provided in an axially offset manner. In the compression cycle, the rotary cylinder block 322 has its intake port 319 which is of lesser diameter than that of the cylinder 332, in communication with the elongated intake port 362 of the housing 312, drawing in air during the first 180° cycle and compressing the air in the second 180° cycle. When the rotary cylinder block port 319 reaches the aligned outlet transfer port 370 in the fixed housing 312, the compressed air/fuel mixture is pumped into the combustion chamber 368. Alternately, fuel may be injected into the combustion chamber 368 as previously described in the other embodiments, with combustion taking place producing an increase in heat and pressure. The combustion process continues within the combustion chamber, which is closed for one full cycle, until the power piston **334*a* which is at bottom dead center, reaches and passes top dead center, whereupon the expanding gases pass from the funnel-shaped center portion of the combustion chamber and into the opening passage 329 formed in the outer sleeve of the rotary cylinder block 322. Passageway 329 communicates with the chamber of the power piston 334*a*, allowing the combustion gases to enter under pressure therein driving the piston in a downward and sliding motion to impart rotary torque to the drive shaft 320. After the power transfer port is closed, the expanding gases continue to exert torque against the piston. During the interval when the pressurized gases are being transferred, the pressure in the combustion chamber 368** decreases somewhat. The combustion chamber is repetitively closed again and the pressure remains low until the compression piston cylinder introduces a new charge of compressed air and fuel into the combustion chamber. The combustion flame is continuous during the repetitive cycle operation as in the aforedescribed embodiments. In small units, this engine may be air cooled with the usual fins and fan.

OFFSET TWIN BANK DUAL CYLINDER ENGINE

FIGS. 25 and 26 represent a further contemplated engine embodiment having adjacent twin banks of dual, diametrically opposed cylinders, and with the common axis of the cylinders of one bank rotated 90° out of phase relative to the common axis of the cylinders of the adjacent bank. The fixed cylindrical housing 412 houses the rotary cylinder block 422 and the eccentrically journaled rotary drive shaft 420 in the same general manner as described relative to the embodiments of FIGS. 1–12, and FIGS. 23 and 24. Empirical testing may show another relative phase between the two banks to be more effective.

The rotary drive shaft 420 extends through both banks of cylinders, has opposite cylindrical shaft ends journaled in bearing means 418 in generally the same manner as the embodiment of FIG. 1. The shaft is provided with a pair of medially adjoining, heavy duty, generally planar piston-supporting portions 421. The respective major planes of portions 421 are disposed at right angles to one another constituting the generally T-shaped rotor or rotary drive shaft 420 and facilitating the 90° out-of-phase relationship.

The pistons may be mounted fixedly upon rectangular reciprocating base plates 436 in a manner similar to that as in the foregoing embodiments, with the axis of the piston's cylinders 432 in each bank of the rotary block 422 being coaxial. To prevent undesired rotation of the cylindrical pistons on their axes (unless pistons of elliptical cross-section are used), each planar portion 421 of the shaft 420 may be provided with spaced parallel guide flanges 423 between which the reciprocating piston-mounting plates 436 have suitable bearings, responsive to rotation of the eccentric shaft 420 and the rotary cylinder block 422. The rotary cylinder block 422, is internally divided into two bank portions, each of which is provided with an internal enlarged opening 425 (FIG. 26) defined in part by opposed parallel walls **425*a* (FIG. 26) spaced apart a distance greater than that of the combined planar portion 421 and the related base plates 436. This said greater distance corresponds to slightly more than the amount of the eccentric offset of the axis of the shaft 420 relative to the common axis of the rotary cylinder block 422 and the stationary housing 412. This internal or center opening 425 further is defined in part by transversely opposed preferably arcuate walls 425*b*, whose arcuate surfaces are shown concentric to the circular outer periphery of the rotary cylinder block 422. The piston-mounting base plates 436, for each bank, are of a length transverse to the axis of the pistons such that they are of lesser extent than the distance between the arcuate walls so as not to interfere therewith during engine operation. The piston's cylinders 432 are of uniform diameter and open fully to the outer periphery of the rotary cylinder block 422**.

Means other than a similar type of bridle ring, such as 42 used in the first described embodiment, may be used to positively connect together the opposite pistons of each bank to provide them with uniformly opposite positive movement during operation. Such connecting means, when used, may be in the form of an axially disposed rod generally designated 428 (FIG. 25) adapted to pass freely through an elongated slot 427 provided centrally in the planar portions 421 of said shaft. The pistons 434 are then mounted in any suitable manner, as by complemental threads or by wrist pin connection, upon the opposite ends of the rod 428, which rod ends also pass through a press fit hole correspondingly provided in each of the base plates 436. Spacing washers 426 are used to keep the two base plates 436 spaced in the proper distance apart.

One bank of cylinders and pistons serves as the air intake/compressor bank, while the other serves as the power/exhaust bank, similar to that of the first-described embodiment of FIG. 1. For illustrative purposes, the left-hand bank in FIG. 25 will provide the intake/compression function and the right-hand bank provides the power/exhaust function. Accordingly the housing 412 includes the air intake port 462 (FIG. 26) and the exhaust port 464. Further, the housing is provided with fluid transfer ports for each bank, the port 470 being on the intake bank side, and port 472 being on the power bank side, and which ports respectively correspond to ports 70 and 72 in the first-described embodiment.

Suitable lubrication and cooling are provided, such as in the previous embodiments, and the operational principle of this engine embodiment is basically the same as that of FIGS. 1–3 although the combustion chamber and related passageways are not shown in FIGS. 25 and 26. It is understood that a similar external combustion chamber would be useable in this embodiment, in which the air-fuel mixture would also burn continuously once initially ignited. The features of other embodiments may be used with this embodiment, is desired.

COMPOUND EXPANSION ENGINE

The mechanical efficiency and potential output power of the basic engines disclosed hereinabove are considered to be much better than other known prior art types of engines on a power-to-weight basis. Therefore, if the same relative amounts of fuel and air are used, the more power produceable as a result thereof will have to go somewhere. Thus, either the amount of fuel and air mixture will have to be reduced, or other means will have to be provided to have the outlet transfer port from the combustion chamber open longer and thereby providing supercharging for the power stroke with attendant increased amounts of pressure of the exhaust over that of other conventional engines.

Therefore, it is contemplated to utilize the greatly increased pressures of these compact and more efficient engines in a compound expansion manner which subsequently will reduce the exhaust pressures down to various predeterminable levels, even approximating that of atmospheric pressure if desired. This can be achieved by diverting part of the power of the power stroke through suitable transfer passages from the main power bank to one or more additional adjacently disposed power banks of pistons and chambers. FIGS. 27, 28 and 29–32 are representative of such a compound expansion engine and will be further described.

Figure 27:
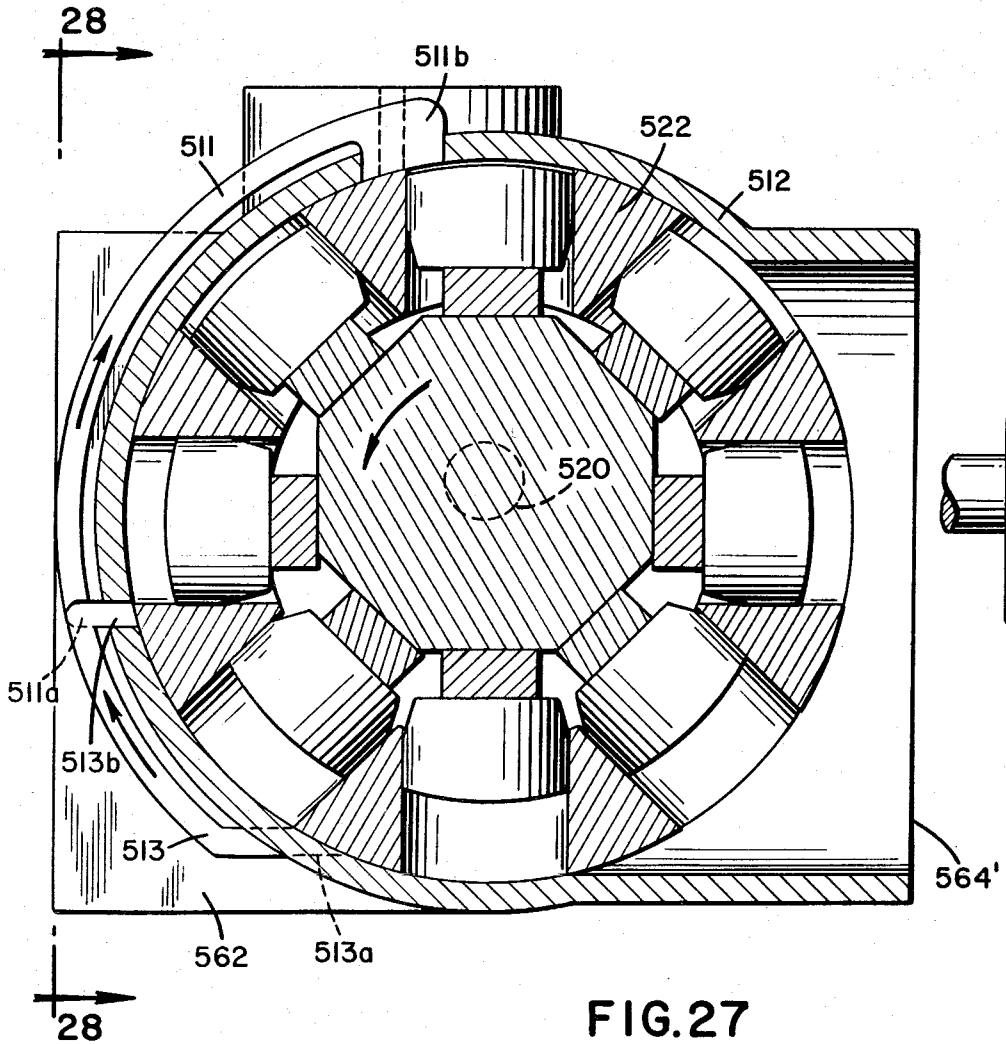
FIG. 27 is an enlarged cross-sectional view of an 8-cylinder per bank embodiment provided with a compound expansion system, as seen substantially on line 27—27 of FIG. 28.

FIG. 28 represents a side elevational view of an 8-cylinder engine 510 of the type basically disclosed in FIGS. 1–4, except that it is eight cylinders, instead of six cylinders, and it is provided with additional power or compound banks of pistons and cylinders, portions of which are interconnected by various fluid transfer ducts and ports. Considering FIG. 28, from left to right, the intake designated 562 corresponds to the main intake 62 of FIGS. 2 and 4, used in conjunction with the intake/-compressor bank of pistons. Next adjacent thereto is a first power bank having a dotted line exhaust outlet 564. Still further compound banks are shown having the dotted line exhaust outlets 564' and 564''. These exhaust outlets generally correspond to the exhaust outlet 64 in FIGS. 3 and 4, and are dotted because they are disposed on the hidden far side of the engine housing 512. FIG. 27 shows exhaust outlet 564' and middle bank of power pistons in cross-section.

A first fluid transfer passageway or duct generally designated 511 is provided to interconnect generally first quadrant portions of the first and second power banks, as shown. More specifically, duct 511 leads from outlet port **511*a* (FIG. 28) in the first power bank, thereby shunting part of the substantial initial power diagonally over to port 511*b* in the second power bank (FIGS. 27 and 28**).

Similarly, secondary stage duct 513, for the lower quadrant or latter part of the 180° cycle, leads from outlet port **513*a* in the first power bank diagonally over to port 513*b*** in the second power bank. It is apparent that the same general arrangement is used for the third or additional compound power bank.

In the subject embodiment of a compound expansion engine, the first power bank receives the total pressure from the combustion chamber, with additional adjacent power banks sequentially receiving progressively lesser pressures as the pistons retract further within their chambers as the 180° power cycle nears its completion. The power pistons in the second and third power banks of this type engine advantageously have a low pressure when at their top dead center positions just prior to coming into communication with the power thrust of the combustion gases from the transfer ports 511*b* and 511*b*'. This will be elaborated upon further hereinafter. Transfer port 511*a* is disposed about midway of its 180° power cycle, whereas the second bank's entry port 511*b* is placed just beyond the top dead center position. The substantial thrust of this diverted portion of the expansion power is used to also impart torque to the drive shaft 520, while simultaneously progressively lowering the ultimate exhaust pressure. The third bank of power pistons, when used, would be likwise driven by part of the fluid pressure further diverted through branch duct 511'.

A second stage power transfer system is accomplished in the same general manner by the duct 513 whose transfer port 513*a* is also in the first bank and located near the end of the 180° power cycle, preceding the commencement of the exhaust cycle.

A further exemplary description concerning the first stage fluid pressure transfer in this compound engine will now be made in reference to FIGS. 29–32.

Figure 29:
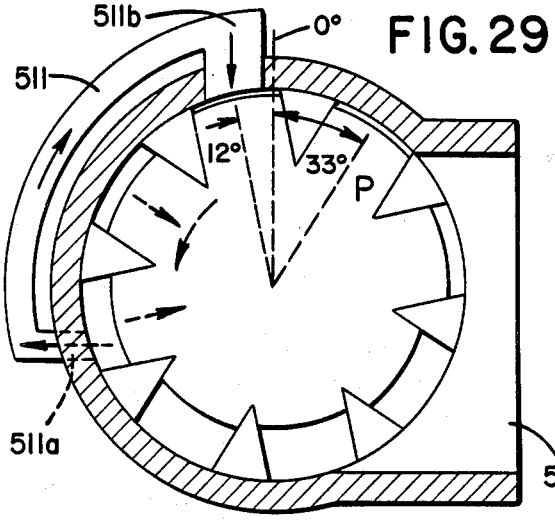
FIGS. 29, 30, 31 and 32 are diagrammatic views showing a progressive series of relative positions of the pistons of an illustrative 8-cylinder per bank engine having means for facilitating a compound expansion of the combusted gases.

Schematic FIG. 29 is representative of the second power expansion bank with the designated piston P in its chamber in a position immediately after passing and closing off from the exhaust port 564'. Piston P is at approximately 33° from the top dead center (TDC) position. Upon closing off from the exhaust port, the pressure within that piston chamber is substantially atmospheric pressure, but in the time that it continues its travel beyond the exhaust port up to top dead center, the trapped gas remaining therein will be compressed to a higher pressure as will be discussed hereinafter.

Figure 30:
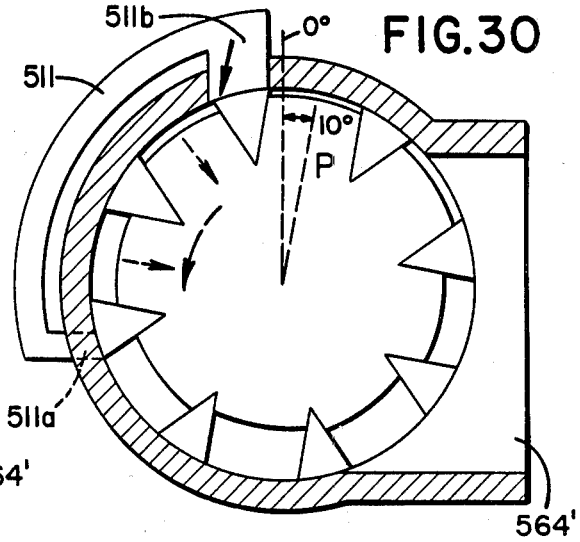
Figure 31:
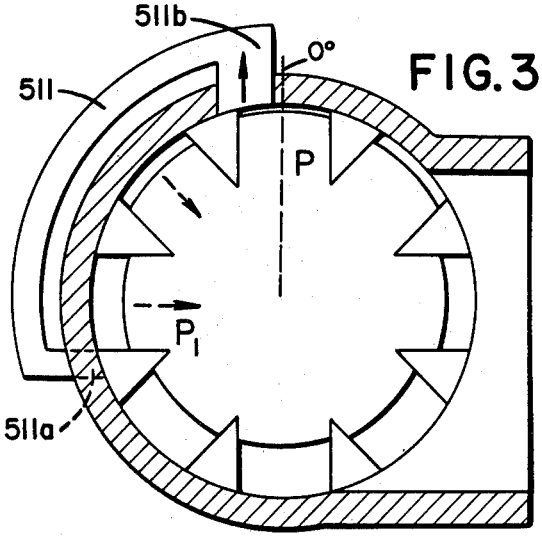

In FIG. 30, the same piston P is shown advanced to within approximately 10° of top dead center just before reaching the top transfer port 511*b*. These relative dispositions are exemplary only, and empirical testing may dictate relocation of the port and rotor shaft orientation. At the position shown in FIG. 30, the pressure in the cylinder of piston P is considered to be built up again to an exemplary pressure of say 50 p.s.i. Keeping in mind that the engine is running and the pressure in the connecting transfer duct 511 is also essentially the same exemplary pressure of 50 p.s.i., then as the piston P finishes its stroke by moving to top dead center as shown in FIG. 31, the transfer port 511*b* opens thereinto with the pressure in the cylinder of piston P and the transfer duct 511 both being at the stated 50 p.s.i. Note the lower port 511*a* in the first bank is closed at this position, as shown in FIGS. 30 and 31. Therefore, the compression of the gases left in the piston during the remaining part of the exhaust stroke, after closing off from the exhaust port, raises the pressure both in the said cylinder and in the transfer duct 511 from the 50 p.s.i. up to the exemplary 100 p.s.i.

Figure 32:
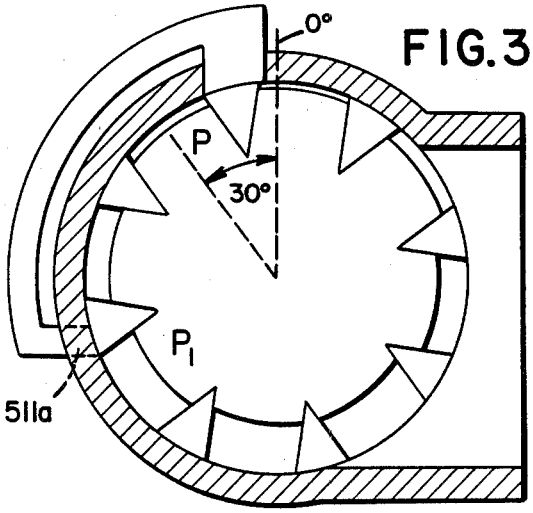

Referring further to FIGS. 31 and 32, during the time that the piston P is moving across the remaining part of the upper port 511*b*, the piston starts on its radially inward stroke. At the moment the piston starts this inward stroke after moving beyond the top dead center position, the lower transfer port 511*a* of the first power bank opens, with the pressure in both this cylinder and in the connecting pipe 511 both being the exemplary 100 p.s.i. and in communication with one another.

Now, as both the top piston P of the second power bank, and the side piston P1 (disposed at approximately 270°) of the first power bank being on their radially inward strokes, the respective volumes in these cylinders increases thereby causing the respective pressures to drop on the initial exemplary 100 p.s.i. down to about 50 p.s.i. Because there is a relatively large volume in the lower cylinder of the piston P1 and a relatively lesser volume in the top cylinder of piston P, the gas pressure will naturally flow from the lower cylinder of piston P1 via the transfer duct 511 up into the top or upper cylinder of piston P.

Upon the preceding transfer of fluid, the pressure is again reduced to the exemplary lesser pressure of say 50 p.s.i. in the connecting transfer duct 511, and inasmuch as the engine is running a repetition of the previously described process occurs whereby the pistons passing the exhaust outlet duct again act to raise the 50 p.s.i. back up to the 100 p.s.i. which is done with each succeeding piston during their completion of their 180° exhaust cycle between BDC and TDC.

The difference between the compound engine of this invention and conventional compound engines with which I am familiar, will now be discussed. In the present engine each of the banks of pistons have their exhaust cycle commencing at substantially bottom dead center (BDC). In other type conventional compound engines, the high pressure piston does not exhaust at BDC, but is required to make the return stroke under pressure as the gases are transferred into a low pressure cylinder specially provided therefore. In those conventional compound engines, the final volume of expanded gases is that volume within the said low pressure cylinder. The volume in the high pressure cylinder of such prior conventional compound engines is lost because the high pressure piston is required to pump back the said pressure into a low pressure cylinder. Because it necessarily utilizes part of the engine's power to pump the pressure back, an alternative has been to provide an extra large low pressure cylinder to make up for this area loss. In comparison to this, in the instant compound engine of this invention, each piston returns to the TDC position with the exhaust having been opened essentially all the time so there is no pressure load and accordingly no area loss.

It is apparent that in conventional engines considerable power is lost in the exhaust pressures; and while experimental engines have been built with large low pressure cylinders added thereto for the purpose of expanding these gases down to nearly atmospheric pressure, this entails substantial extra cost, which together with additional engine friction and further attendant heat loss transfer, collectively serve to offset any potential merit of the low pressure expansion cylinders.

In contradistinction to this, the compound expansion embodiment of my engine has a much lower normal heat loss with the result that the exhaust will be at much higher temperatures and pressures. Accordingly, the utilization of additional power banks of pistons and cylinders will provide for added torque and ultimately reduced exhaust pressures to essentially atmospheric pressure. In this present engine most of the transfer loss of heat will be eliminated because of the continuous flow into the combustion chamber, the continuously burning combustion chamber and the minimum travel of the piston within the chamber at its generally TDC position as it comes into communication with the combusted gases transferred from the combustion chamber to the power bank of pistons. The provision of additional power banks will not appreciably increase the engine friction, since the same bearings at the end of the elongated shaft will be used. The rotary drive shaft will merely be elongated as will be the sliding base plates upon which the pistons will be mounted. The planar surfaces of the base plates, while providing somewhat more bearing surface, but the required movement, will be the same as for a single bank engine. In most conventional engines of the reciprocating piston type using the progressively offset more conventional eccentric crank shafts, there is a separate movement for each piston and each piston rod, whereas in the subject engine the pistons of each additional power bank each becomes an integral unit with the other pistons because they are all mounted on the same sliding base plate, and there is essentially only one collective movement for all of the pistons which is considered to be rotary. Any of the other features in the other embodiments, such as heat exchanger, may be used in this embodiment, as desired. Accordingly, in view of the foregoing differences and advantages, it is apparent that this embodiment of compound expansion engine provides a marked improvement over those of the prior art with which I am familiar.

ONE, TWO, OR THREE STAGE AIR COMPRESSOR

Figure 33:
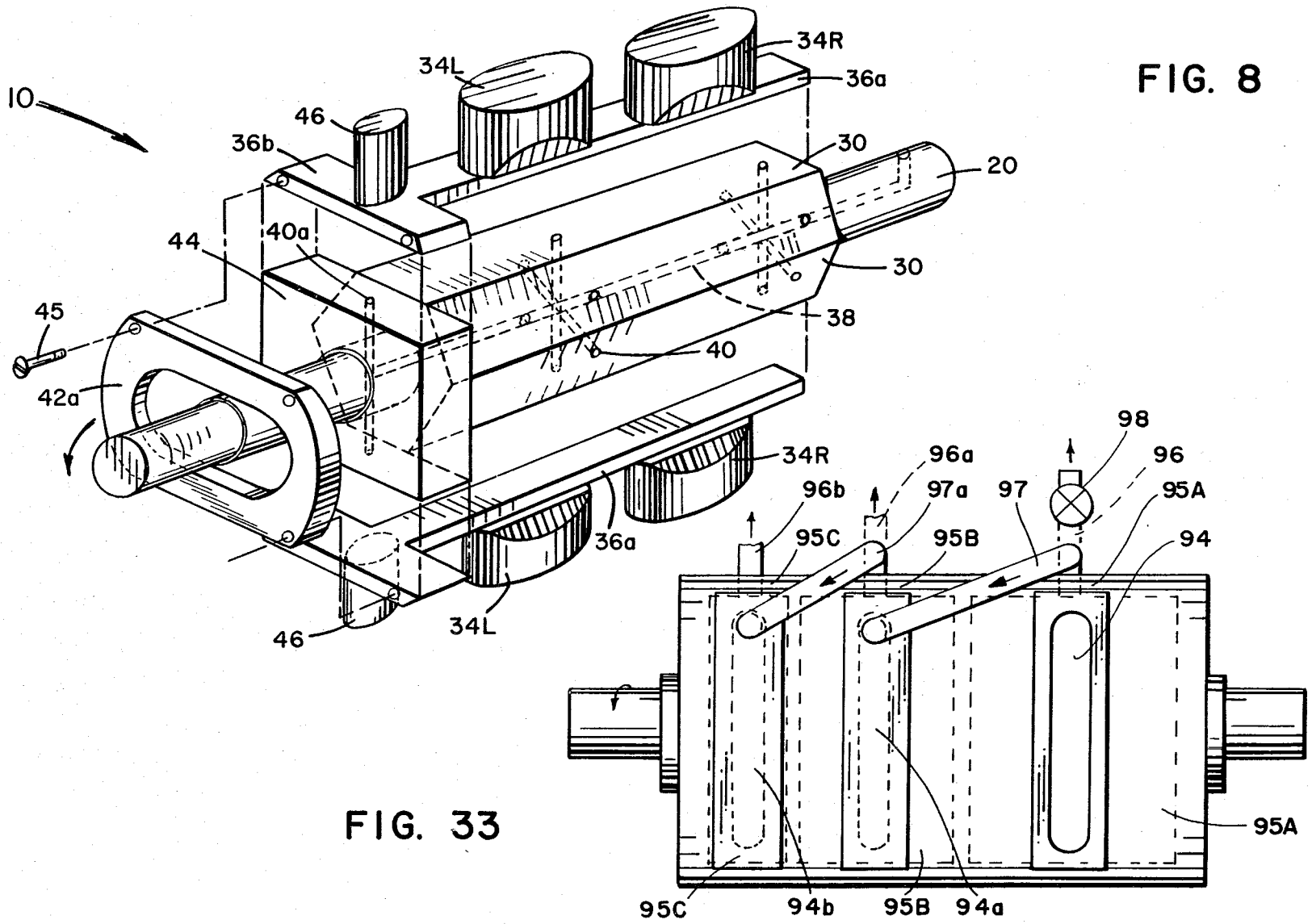
FIG. 33 is a schematic, composite representation of one, two and three stage compressor units embodying the principle of this invention.
Figure 11:
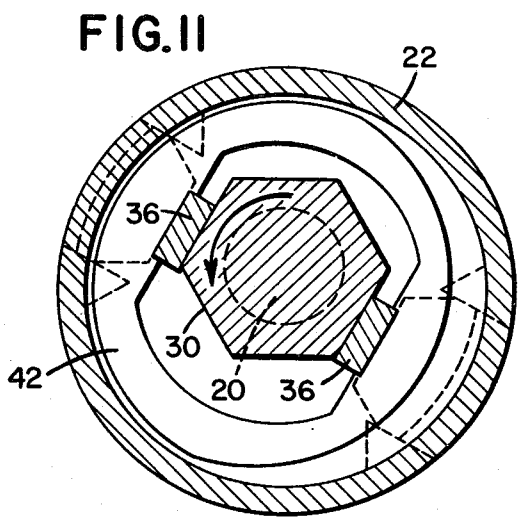
FIGS. 10, 11 and 12 illustrate just one of the three connecting bridle rings shown in FIG. 9, in relation to its pair of opposed piston-mounting base plates and hex shaft, in three progressively different positions during rotation of the rotary cylinder and hex drive shaft with the FIG. 10 position being the same as in FIG. 9.
Figure 10:
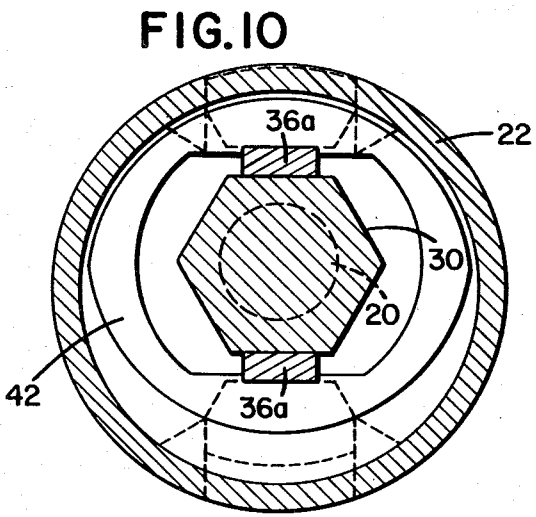
Figure 9:
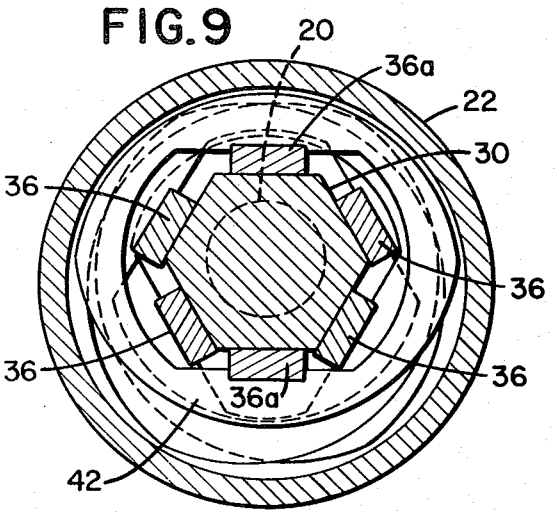
FIG. 9 is a transverse cross-section on a reduced scale as viewed essentially on line 9—9 of FIG. 1 showing details of three connecting bridle rings respectively attached to diametrically opposite piston-mounting plates slidable on the hex portion of the output drive shaft.
Figure 13:
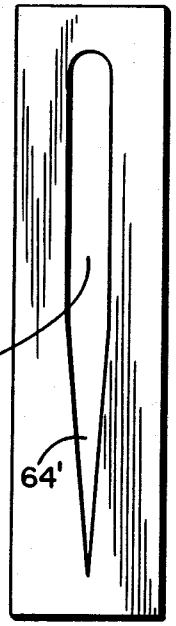
FIG. 13 is an elevational view illustrating the lower V or crevice-shaped portion of an exhaust port, with the narrowest portion thereof disposed to initiate exhaust transfer of fluid when the rotary cylinder chamber is substantially at bottom dead center.

FIG. 33 is a diagrammatic representation of how the engine of this invention can be used in one or more stages as an air compressor. FIG. 33 is a composite diagrammatic view representative of one, two or three stage compressor means. It is apparent in the one stage compressor, that the intake bank of pistons and cylinders, schematically designated 95A, would be used to compress the air which would be transferred via outlet 96 to a collection tank for other use. If more than one stage or bank of compression pistons and cylinders are desired, such as the 2- and 3-stage devices designated 95B and 95C respectively, then preferably a suitable cooling coil means 97 would be provided between the adjacent banks as diagrammatically illustrated. A check valve 98 would be preferred in the outlet pipe 96 of the single stage compressor. The outlet pipe 96 would be moved to position **96*a* in the 2-stage device and to position 96*b* in the 3-stage device, and a check valve would be located preferably at the outlets 96, 96*a*, 96*b*, whichever embodiment is used. The air enters the elongated inlet port 94 for the single stage compressor and also for the others if more than one compressor stage is used. When the second stage is used, air enters from the first stage by conduit 97 into the elongated port 94*a*, and if a third stage is used, through conduit 97*a* into the elongated port 94*b***. It is understood that where the fluid displacement device of the invention is used as a compressor, it may be driven by its own self-contained bank of power pistons and external combustion chamber, or it may be driven by a separate electric motor or other suitable power source.

If the compressor of this type were used in conjunction with the external combustion chamber construction herein, and whose combustive gases would be directed through a venturi thrust chamber used for jet propulsion, the heat would be saved and no cooling coils would be used. It is apparent that any of the combustion chamber constructions to be disclosed herein can be used for jet propulsion purposes, providing the outlet opening is connected with an appropriate outlet thrust chamber.

TWIN BANK 4 CYLINDER PER BANK EMBODIMENT

Figure 34:
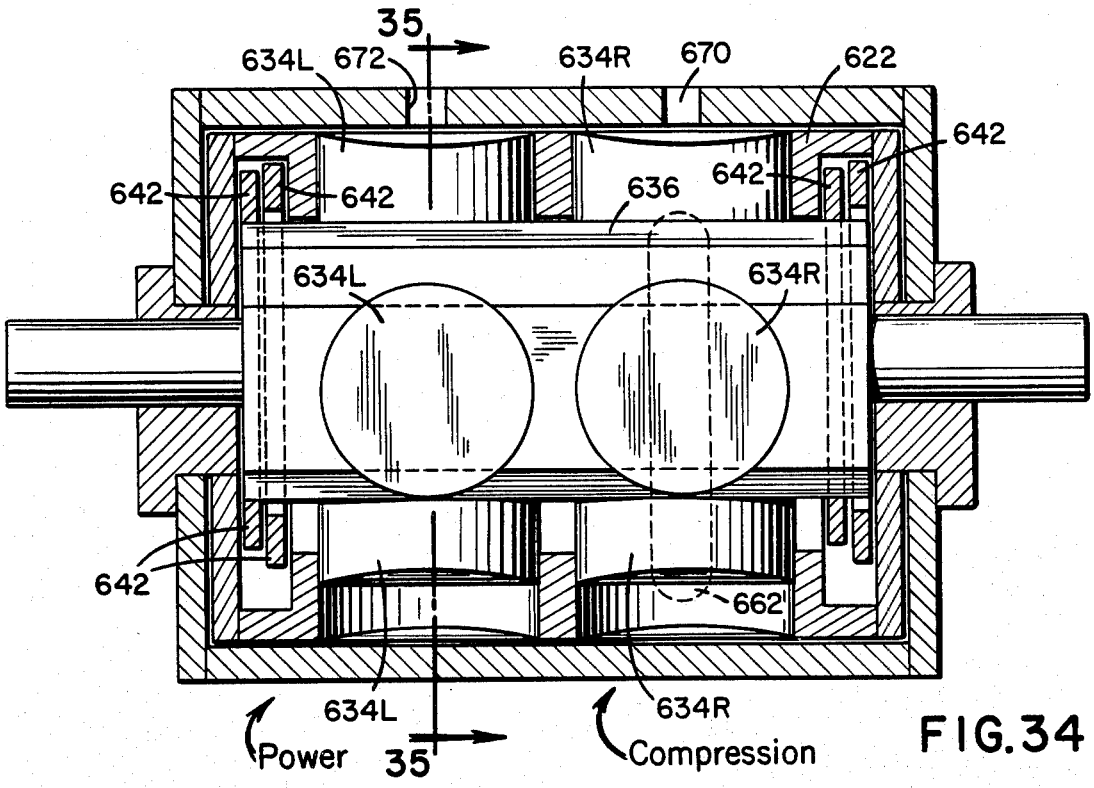
FIGS. 34 and 35 are further longitudinal and transverse cross-sectional views of a two bank, 4 cylinders per bank embodiment, as taken substantially on the respective section lines 34—34 and 35—35 of the respective figures.
Figure 35:
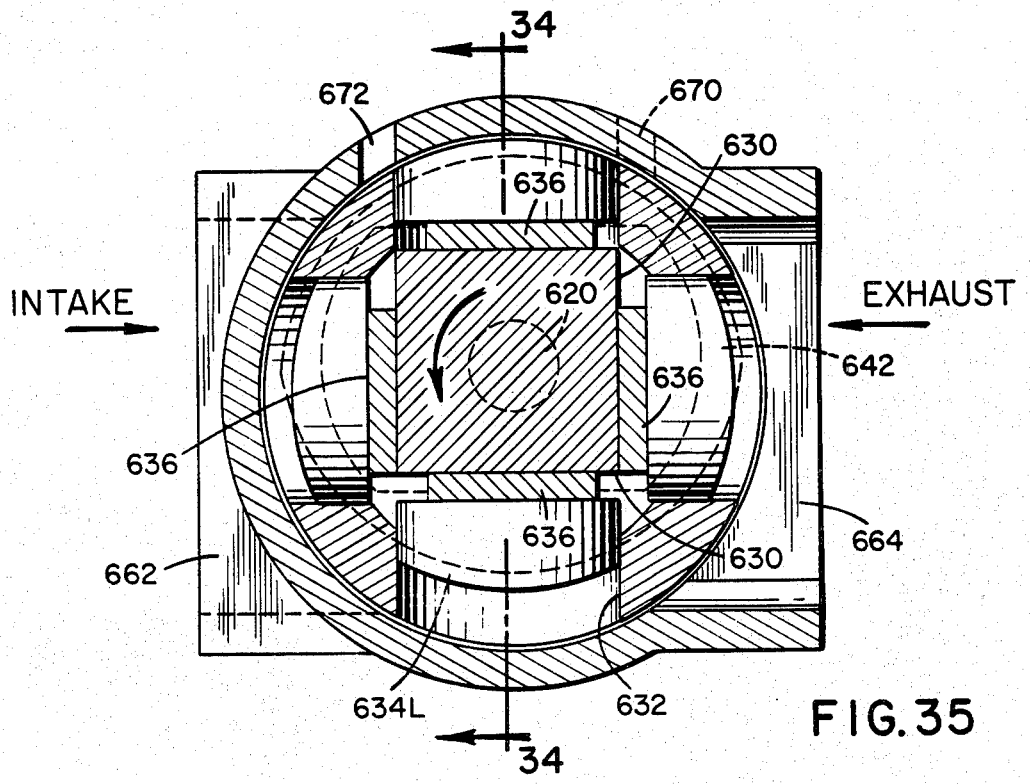

FIGS. 34 and 35 represent a further embodiment having two adjacent banks of 4 equally spaced cylinders and pistons, 632 and 634 respectively. The cylinders 632 are formed in a rotary cylinder block designated 622. The rotary drive shaft 620 is of square cross-section in its medial area and has cylindrical ends journaled in the same eccentric manner as in the previous embodiments. Corresponding pistons 634R and 634L of the adjacent banks represent the intake/compression and power/exhaust pistons, respectively, and are each rigidly mounted on the base plate 636 which is slidably mounted with bearing planar surfaces of the rotary shaft 620.

Diametrically opposed pairs of the base plates 636 are tied together by suitable bridle rings 642 at opposite ends of the shaft, in the like manner as described for the previous embodiments. The principle of operation is also the same as that in the aforedescribed embodiments such as FIGS. 1–3, with the fluid transfer ports 670 and 672 corresponding in fuction to ports 70 and 72 respectively of the FIGS. 1–3 embodiment.

For purposes of brevity and simplicity, no combustion chamber and no ancillary set of smaller pistons corresponding to the pistons 46 in FIGS. 1–3 have been shown in the assembly depicted in these FIGS. 34 and 35 or in other modified embodiments. Generally, reference numbers using the prefix 600 have been used in conjunction with the FIGS. 34 and 35 to identify corresponding part as the embodiment of FIGS. 1–3, i.e. intake 662 and exhaust 664 ports correspond to the ports 62 and 64 respectively in FIGS. 1–3, etc.

MODIFICATION TO BASE PLATES

Figure 36:
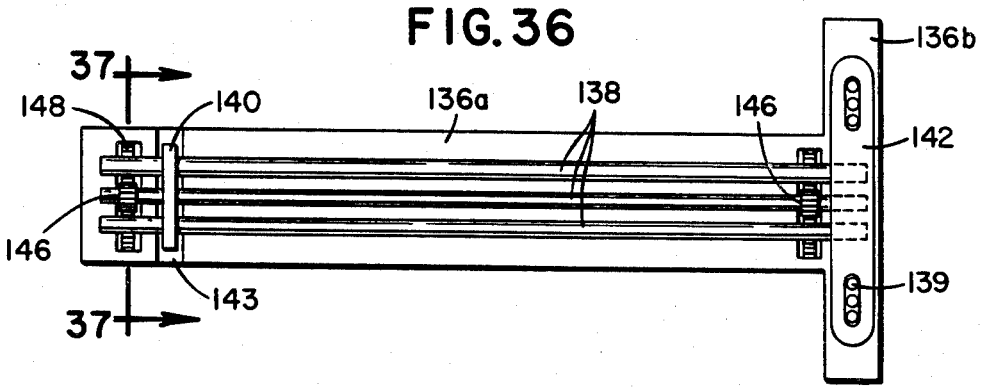
FIG. 36 is a detailed diagram of a T-shaped base plate showing a combination of roller and ball bearings.
Figure 37A:
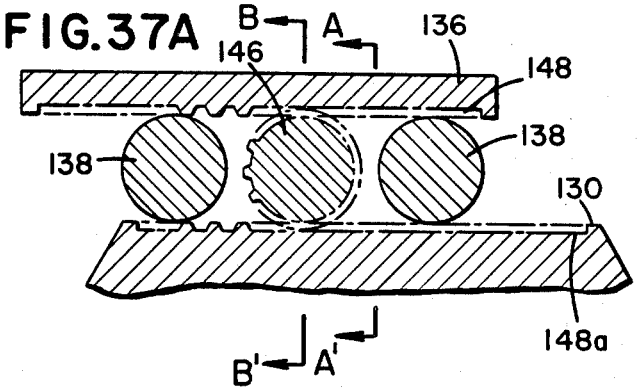
FIGS. 37A and 38 show a detail of FIG. 36 taken on line 37—37.
Figure 37B:
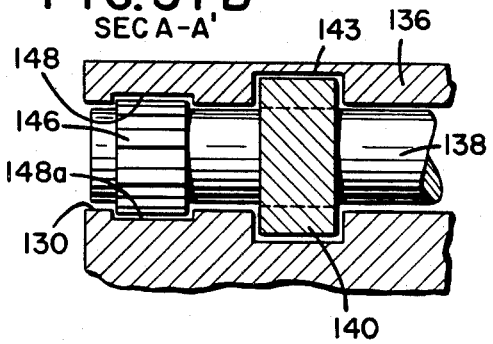
FIGS. 37B and 37C show cross-sectional views of FIG. 37A along section lines A—A' and B—B', respectively.
Figure 38:
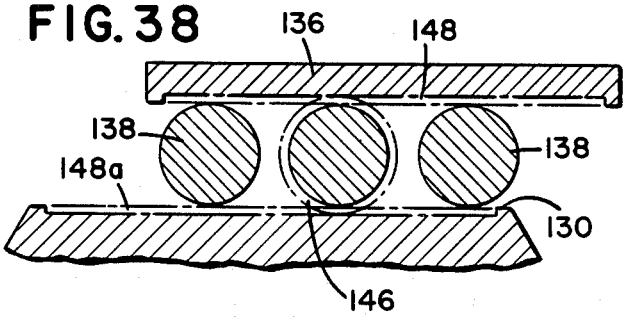
Figure 37C:
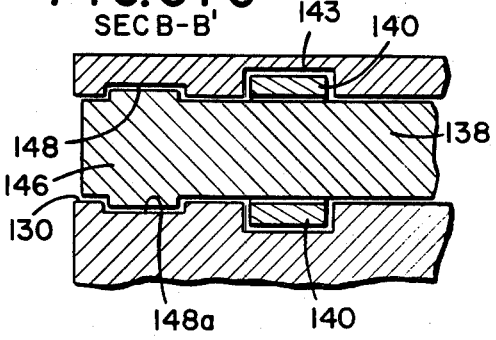

All of the base plates 136 may be fitted with elongated rollers 138 shown in FIG. 36, and these rollers are held in position in the portion **136*a* by supporting guide 140 which can have clearance for movement between recesses 143 in the shaft face 130 and the base plate 136. The T-shaped base plate portion 136*b* engages guides 142 which support the other end of rollers 138 and also become guides for ball bearings 139. The rollers 138 and ball bearings 139 are secured in their operative position by spur gears 146, 146 and the movement of these rollers and ball bearings is controlled by the spur gear rack 148 mounted to the base plate 136 shown in FIGS. 37A, 37B, 37C and 38, and the spur gear rack 148*a* mounted to the planar surface of the drive shaft 130. The spur gears 146 travel only half the distance that the base plate 136 does and therefore the gear racks 148, 148*a* can easily be set into the surface of the drive shaft. The pitch diameter of the spur gears 146 equals the diameter of the rollers 138** to provide synchronous travel.

Figure 39:
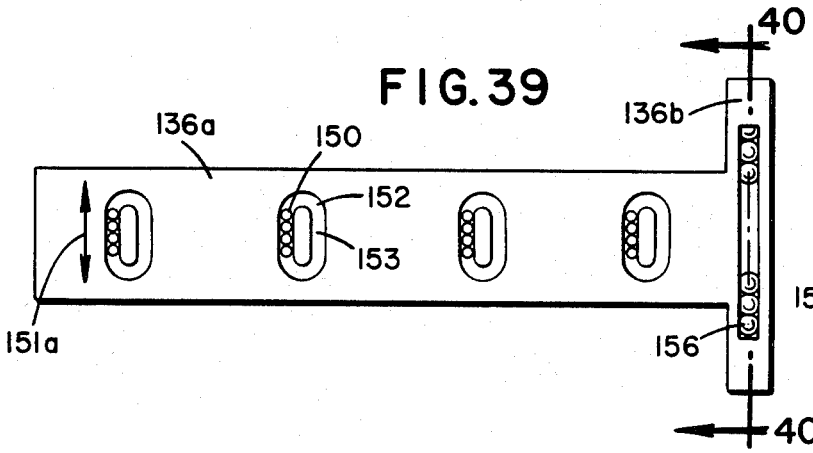
FIG. 39 is a modification of the bearing surface of a T base plate showing ball bearings.

FIG. 39 shows another modification for the bearings used in connection with the base plates 136. Ball bearings 150 guided by grooves 152 in base plate portion **136*a* bear against the linear surface of the drive shaft 130, for the length of their bearing travel 151*a* and they are re-circulated by the clearance grooves 153**.

Figure 40:
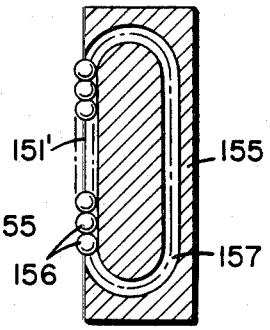
FIG. 40 showing the ball bearing in the T section of the base plate taken on line 40—40 of FIG. 39.

FIG. 40 is taken on line 40, 40 of FIG. 39 and shows the T-shaped base plate portion **136*b* and the bearing assembly 155 which provides for the return of the recirculating balls 156 in the track 157 to enable the base plate 136***b* to bear against T-end 144 shown in FIG. 41.

FIG. 41 shows the bearing assembly 155 in position against the T-shaped end 144 of the drive shaft 120, supported by bridle ring 142.

ADDITIONAL STRUCTURAL DETAILS

FIGS. 42, 43, 44, 45 show the construction of the piston and its mounting on the base plates. The double wrist pins 160 stabilized the pistons and keep them in alignment with the walls of the cylinders. FIG. 43 is a cross-section of the piston taken on line 43, 43 to show its construction for receiving the wrist pin base 161 shown in FIGS. 44 and 45. FIG. 45 is a side view taken on line 45, 45 of FIG. 44 to show the shape of the wrist pin base that fits in the piston as shown in FIG. 43.

FIG. 46 shows the sealing arrangement of the ends of the vanes 60 and the circular members 58. The ends are sealed with small cylinders 58*a* with three slots for receiving one vane 60 and two circular members 58. The center small cylinder 58*b* has four slots for sealing two ends of vanes 60 and two ends of circular members 58. FIG. 48 is a diagrammatic view of the center cylinder 58*b* to show the slot opening 58*d* to receive the vane 60; 58*c* is an extension of the small cylinder to be attached to 58*b*. This is only for the purpose to add convenience for the cutting of the grooves because this end must extend downward without grooves to provide the necessary sealing. FIG. 47 shows the angle of the grooves 58*d* so that the circular members 58 may have a free movement and still maintain the best sealing contact. All of the vanes 60, circular members 58 and the small cylinders 58*a* and 58*b* are provided with suitable springs to maintain sealing contact with the walls.

FIG. 49 shows an alternate arrangement for the ports of the cylinders. When cylinder heads are used in the block 22, the ports 72*a* to the power bank of cylinders can extend longitudinally as channels out at the end of the engine block 22 and terminate with circular band 72A. In stationary band 72B of FIG. 50, mounted on the end of housing 12, the port 70 leads from the combustion chamber 68 as in FIGS. 1–3. When the ports 72*a* in rotating band 72A align with port 70 in stationary band 72B, then the pressures of the combustion chamber 68 pass through and act upon the power pistons as shown in FIGS. 1–3. When the expansion cycle is completed, the ports 72*a* will then rotate and reach the portion of the stationary band 72B connected to the exhaust port 64 for their exhaust cycle as was previously explained. Vanes 60*a* and rings 58*a* suitable for this plate are used here, and each are provided with a suitable spring. The vanes 60*a* are set in a deeper slot so that the area underneath the rings 58*a* are sealed off and cannot pass by or underneath the vanes 60*a*. A similar arrangement would be used on the other end of the engine intake and compression cycles.

In FIG. 51, when two or more banks may be preferred, the pistons 34 can be made in an oblong shape providing a larger area for the expansion or compression of the gases or liquids. Alternately, the pistons could be made of a diaphragm type.

CONCLUSION

From the foregoing detailed disclosure, it is apparent that several embodiments of a novelly improved fluid displacement device of the characters described have been evolved, all of which achieve the objectives and advantages set forth in the preamble and throughout the specification hereinabove.

It is understood that many of the details are cited in the foregoing embodiments are merely exemplary and may be revised or changed by those skilled in the art. For example, the bridle ring members need not be of curvalinear form, but may be more of the rectangular endless form, or less preferably they may include pairs of generally linear tie members to tie together opposite sides of the opposed piston-mounting base plates. Moreover, empirical testing may dictate providing larger or smaller fluid transfer ports, combustion chambers, relative disposition and size of the intake and exhaust ports, and providing the communication between the piston cylinders and the exhaust outlets either slightly before or after the bottom dead center position of the pistons and cylinders. Furthermore, the size of the pistons and amount of eccentricity may also be varied as desired, and/or as required for different desired conditions and horse power requirements.

It is further understood that the various alterations shown throughout are intended to be used in any of the modifications therein they may be desired.

I claim:

1. In a rotary-operated gaseous fluid displacement device for use as an external combustion engine and embodying a stationary housing having fluid intake and discharge ports, and embodying a conjointly rotatable eccentrically disposed piston-supporting rotary shaft and radial-piston-chambered block components within the housing, said rotary shaft disposed eccentrically within an open axial aperture provided within said rotary block component, and having pistons movable between top dead center (TDC) and bottom dead center (BDC) positions respectively during operation, said housing having a cylindrically-shaped internal peripheral wall and opposed end walls disposed transversely to the axis of the cylindrical wall, means for introducing into and igniting a combustible fuel mixture solely within a combustion chamber having communication with the interior of said housing, said combustion chamber mounted externally on said housing, the improvement wherein:

(a) said shaft having a medial portion with at least one pair of diametrically opposed parallel planar surfaces spaced equidistantly from the shaft axis, said planar surfaces disposed for operative reciprocating engagement by the correspondingly disposed pistons;

(b) said rotary block having first, second and third axially spaced banks of corresponding even-numbered circumferentially spaced radial piston chambers, said second one of said banks communicating directly with a fluid discharge port of said externally mounted combustion chamber, said second and third banks being dedicated to a power expansion and exhaust function and the first of said banks being dedicated to the compression of air;

(c) a piston complementally and slidably disposed within each of said diametrically opposed piston chambers and respectively being fully radially extended and radially retracted when in the respective TDC and BDC positions attendant piston travel; said travel constituting sequential 180 degree cycles of operation for imparting operative driving rotation to said shaft and conjointly to said rotatable block components;

(d) valving means for interconnecting said externally mounted combustion chamber with the interior of said housing, said valving means including fluid flow transfer passage means alternately communicating in timed relation with said first and second banks of piston chambers near the TDC positions to effect operation of the engine;

(e) said corresponding pistons of each bank being longitudinally aligned and fixedly connected to elongated piston-mounting base plates, said base plates each having a generally planar portion and constituting a means for providing said operative reciprocating engagement between said pistons and said corresponding planar surfaces of said rotatable shaft;

(f) said device further including means for introducing a combustible fluid mixture fuel into said external combustion chamber, and means for igniting said fuel whereby the combustion gases are directed from said chamber via a part of said fluid flow passage means and against said pistons of said second bank individually in a sequentially continuous manner constituting a 180 degree power cycle to impart continuous rotary drive to said shaft;

(g) secondary fluid transfer passage means including at least a first conduit which interconnects said pistons and cylinders of said second bank at a point approximately midway of its power cycle and operatively connecting with the pistons and cylinders of said third bank at a point to exert positive supplemental driving pressure as they pass top dead center position and commence their corresponding power cycle;

(h) each of said second and third banks having fluid discharge ports for exhausting spent combusted gases; and (i) said secondary fluid transfer passage means including a second conduit connected generally in parallel to said first conduit, but interconnecting said second bank commencing at a point substantially beyond said midway point of its power cycle, and operatively connecting with said adjacent third bank at a point approximately midway of said corresponding supplemental power cycle.

2. The device of claim 1, wherein a fourth axially adjacent bank of cylinders and pistons, dedicated to power expansion and exhaust, is provided and wherein a tertiary fluid transfer passage means interconnects said third bank to said fourth bank.

3. The device of claim 2, wherein said tertiary fluid transfer passage means includes a third conduit interconnected with said first conduit where said first conduit is operatively connected with the pistons and cylinders of said third bank, said third conduit operatively connected with the pistons and cylinders of said fourth bank at a point to exert positive supplemental driving pressure as they pass a top dead center position and commence their corresponding power cycle.

4. The device of claim 3, wherein said tertiary fluid transfer passage means includes a fourth conduit interconnected with said second conduit where said second conduit is operatively interconnected with said third bank.

5. The device of claim 4, wherein said power pistons in said second, third and fourth power pistons are at their respective TDC positions just prior to coming into communication with the power thrust of the combustion gases, said power thrust coming from the externally mounted combustion chamber for said pistons of the second bank, and from the first and third conduits for the pistons of the second and third banks, respectively.

6. The device of claim 5, wherein said second, third and fourth banks of power pistons enter into misalignment with their respective exhaust ports just prior to assuming their respective TDC positions so that a low pressure exists in the respective piston chambers just prior to receipt therein of combustion gases from said externally mounted combustion chamber, said first conduit and said third conduit, respectively.

7. The device of claim 6, wherein said first conduit is disposed between said second and third banks of power pistons and specifically positioned so that when a piston in said third bank moves to its TDC position, said first conduit is closed where it operatively interconnects with said second bank so that the pressure in said first conduit is increased just prior to the opening of said first conduit into said second bank.

8. The device of claim 7, wherein the pistons of said second, third and fourth banks are substantially at their respective BDC positions at the commencement of their exhaust cycles so that the higher pressure pistons do not make a return stroke under pressure as the gases are transferred into a low pressure cylinder as in conventional compound expansion engines.

9. The device of claim 8, wherein the cylinders of the second, third and fourth banks of power pistons are of substantially equal dimension as a result of the absence of a need to provide a large low pressure cylinder.

10. The device of claim 9, wherein the pressure of the combustion gases is lowered to atmospheric pressure through the provision of conduits that interconnect axially adjacent banks of power pistons, each bank of which completes it exhaust cycle by exhausting combustion gases to atmosphere.

* * * * *